US010982627B2

(12) United States Patent
Keblusek

(10) Patent No.: US 10,982,627 B2
(45) Date of Patent: Apr. 20, 2021

(54) VARIABLE SPEED COOLANT PUMP CONTROL STRATEGY

(71) Applicant: International Engine Intellectual Property Company, LLC, Lisle, IL (US)

(72) Inventor: Michael Charles Keblusek, Lombard, IL (US)

(73) Assignee: International Engine Intellectual Property Company, LLC., Lisle, IL (US)

( * ) Notice: Subject to any disclaimer, the term of this patent is extended or adjusted under 35 U.S.C. 154(b) by 0 days.

(21) Appl. No.: 16/414,332

(22) Filed: May 16, 2019

(65) Prior Publication Data

US 2020/0362800 A1 Nov. 19, 2020

(51) Int. Cl.

| | |
|---|---|
| ***F01P 7/16*** | (2006.01) |
| ***F02M 26/04*** | (2016.01) |
| ***F02M 26/28*** | (2016.01) |
| ***F02D 41/00*** | (2006.01) |

(52) U.S. Cl.

CPC ..... *F02M 26/04* (2016.02); *F02D 41/0002* (2013.01); *F02D 41/005* (2013.01); *F02M 26/28* (2016.02)

(58) Field of Classification Search

CPC ..... F01P 7/164; F01P 3/20; F01P 7/00; F01P 7/14; F01P 7/16; F02M 26/04; F02M 26/28; F02D 41/005; F02D 41/0002

See application file for complete search history.

(56) References Cited

U.S. PATENT DOCUMENTS

| | | | | |
|---|---|---|---|---|
| 4,768,484 | A * | 9/1988 | Scarselletta | F01P 3/22 123/41.21 |
| 6,178,928 | B1 * | 1/2001 | Corriveau | F01P 7/048 123/41.12 |
| 6,374,780 | B1 * | 4/2002 | Rutyna | F01P 7/048 123/41.12 |
| 10,480,391 | B2 * | 11/2019 | Gonze | F01P 7/14 |
| 2002/0152972 | A1 * | 10/2002 | Iwasaki | F01P 7/164 123/41.44 |
| 2004/0194910 | A1 * | 10/2004 | Garner | F01P 3/22 165/11.1 |

* cited by examiner

*Primary Examiner* — Sizo B Vilakazi

(74) *Attorney, Agent, or Firm* — Jeffrey P. Calfa; Jack D. Nimz

(57) ABSTRACT

A system and method of controlling variable speed coolant pumps for vehicle cooling systems utilizes a controller that incorporates measured heat rejection and hydraulic system performance data of the cooling system. The controller calculates coolant flow and pressures at reduced coolant pump speeds. The controller then predicts coolant temperatures at the reduced water pump speeds, and establishes a maximum allowable heat flux to avoid boiling of the coolant. The controller then optimizes the speed of the variable speed coolant pump to prevent the coolant from exceeding the maximum allowable heat flux. The maximum allowable heat flux may be determined by keeping the heat flux within a region characterized by interface evaporation pure convection and/or within a region characterized by nucleate boiling bubbles condensing. The controller may also determine power savings created by optimizing the speed of the coolant pump.

20 Claims, 19 Drawing Sheets

FIG.6A
| Category | Year | CO Emissions g/bhp-hr | Fuel Consumption* gallon/100 bhp-hr |
|---|---|---|---|
| MHD Engines | 2014 | 502 | 4.93 [a] |
| | 2017 | 487 | 4.78 |
| | 2021 | 473 | 4.6464 |
| | 2024 | 461 | 4.5285 |
| | 2027 | 457 | 4.4892 |
| HHD Engines | 2014 | 475 | 4.67 [a] |
| | 2017 | 460 | 4.52 |
| | 2021 | 447 | 4.3910 |
| | 2024 | 436 | 4.2829 |
| | 2027 | 432 | 4.2436 |
*Equivalent NHTSA standards based on 10,180 & $CO_2$ per gallon of diesel
*Voluntary in MY 2014 and MY 2015
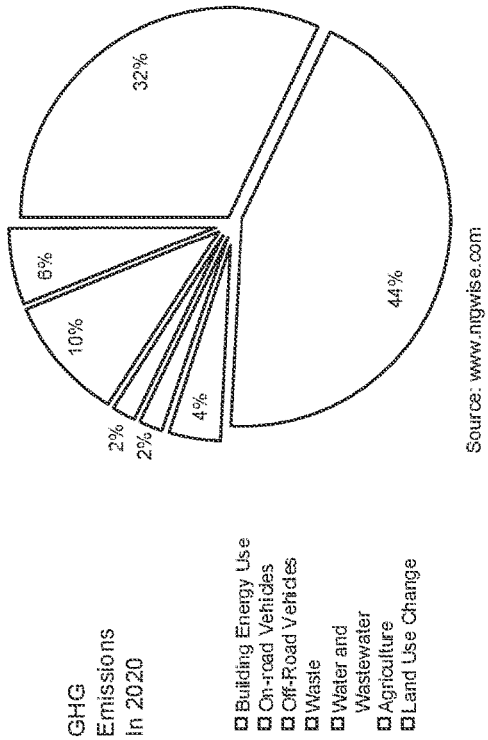
FIG.6B
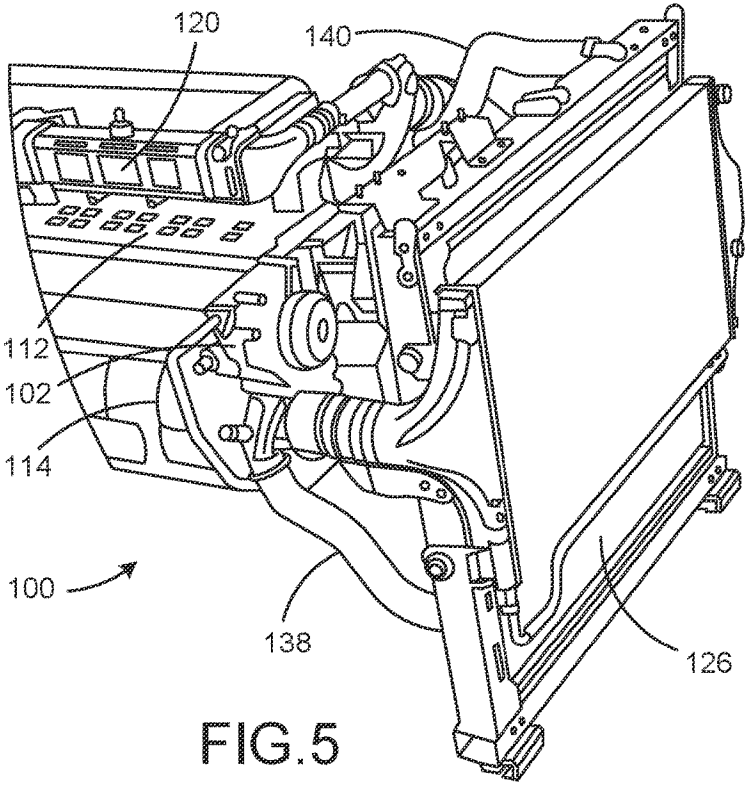
FIG.5

800

808

| Conventional Water Pump Horsepower demand by speed and load | | | | | | |
|---|---|---|---|---|---|---|
| Engine Load | | | | | | |
| 100% | 1.41 | 2.54 | 4.12 | 6.23 | 7.50 | 10.55 |
| 80% | 1.41 | 2.54 | 4.12 | 6.23 | 7.50 | 10.55 |
| 60% | 1.41 | 2.54 | 4.12 | 6.23 | 7.50 | 10.55 |
| 40% | 1.41 | 2.54 | 4.12 | 6.23 | 7.50 | 10.55 |
| 20% | 1.41 | 2.54 | 4.12 | 6.23 | 7.50 | 10.55 |
| Engine Speed | 1000 | 1200 | 1400 | 1600 | 1700 | 1900 |

810

FIG.21A

802

808

| Allowable speed reduction ratio | | | | | | |
|---|---|---|---|---|---|---|
| Engine Load | | | | | | |
| 100% | 1.00 | 1.00 | 1.00 | 1.00 | 1.00 | 1.00 |
| 80% | 0.90 | 0.80 | 1.00 | 1.00 | 1.00 | 0.80 |
| 60% | 0.40 | 0.40 | 0.60 | 0.50 | 0.50 | 0.30 |
| 40% | 0.40 | 0.40 | 0.30 | 0.30 | 0.30 | 0.30 |
| 20% | 0.40 | 0.40 | 0.30 | 0.30 | 0.30 | 0.30 |
| Engine Speed | 1000 | 1200 | 1400 | 1600 | 1700 | 1900 |

810

FIG.21B

804

| Optimized Variable speed water pump Horsepower demand and by speed and load | | | | | | |
|---|---|---|---|---|---|---|
| Engine Load | | | | | | |
| 100% | 1.41 | 2.54 | 4.12 | 6.23 | 7.50 | 10.55 |
| 80% | 1.00 | 1.24 | 4.12 | 6.23 | 7.50 | 5.32 |
| 60% | 0.02 | 0.08 | 0.79 | 0.67 | 0.82 | 0.19 |
| 40% | 0.02 | 0.08 | 0.03 | 0.08 | 0.11 | 0.19 |
| 20% | 0.02 | 0.08 | 0.03 | 0.08 | 0.11 | 0.19 |
| Engine Speed | 1000 | 1200 | 1400 | 1600 | 1700 | 1900 |

808

810

FIG.21C

806

| Water Pump power savings as a percentage of the conventional pump | | | | | | |
|---|---|---|---|---|---|---|
| Engine Load | | | | | | |
| 100% | 0% | 0% | 0% | 0% | 0% | 0% |
| 80% | -29% | -51% | 0% | 0% | 0% | -50% |
| 60% | -99% | -97% | -81% | 0.67 | -89% | -98% |
| 40% | -99% | -97% | -99% | -99% | -99% | -98% |
| 20% | -99% | -97% | -99% | -99% | -99% | -98% |
| Engine Speed | 1000 | 1200 | 1400 | 1600 | 1700 | 1900 |

808

810

814

FIG.21D

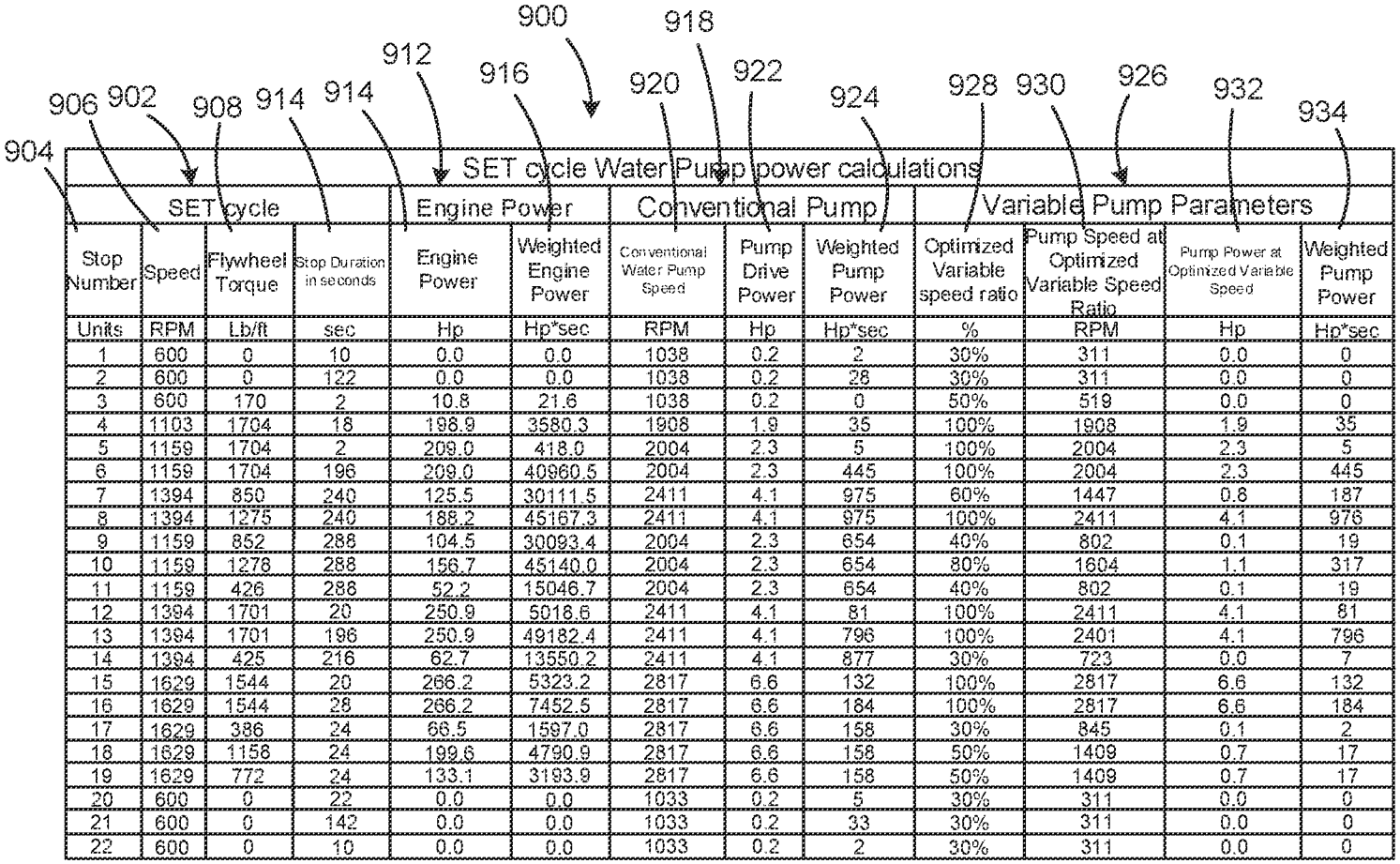

| Stop Number | Speed | Flywheel Torque | Stop Duration in seconds | Engine Power | Weighted Engine Power | Conventional Water Pump Speed | Pump Drive Power | Weighted Pump Power | Optimized Variable speed ratio | Pump Speed at Optimized Variable Speed Ratio | Pump Power at Optimized Variable Speed | Weighted Pump Power |
|---|---|---|---|---|---|---|---|---|---|---|---|---|
| Units | RPM | Lb/ft | sec | Hp | Hp*sec | RPM | Hp | Hp*sec | % | RPM | Hp | Hp*sec |
| 1 | 600 | 0 | 10 | 0.0 | 0.0 | 1038 | 0.2 | 2 | 30% | 311 | 0.0 | 0 |
| 2 | 600 | 0 | 122 | 0.0 | 0.0 | 1038 | 0.2 | 28 | 30% | 311 | 0.0 | 0 |
| 3 | 600 | 170 | 2 | 10.8 | 21.6 | 1038 | 0.2 | 0 | 50% | 519 | 0.0 | 0 |
| 4 | 1103 | 1704 | 18 | 198.9 | 3580.3 | 1908 | 1.9 | 35 | 100% | 1908 | 1.9 | 35 |
| 5 | 1159 | 1704 | 2 | 209.0 | 418.0 | 2004 | 2.3 | 5 | 100% | 2004 | 2.3 | 5 |
| 6 | 1159 | 1704 | 196 | 209.0 | 40960.5 | 2004 | 2.3 | 445 | 100% | 2004 | 2.3 | 445 |
| 7 | 1394 | 850 | 240 | 125.5 | 30111.5 | 2411 | 4.1 | 975 | 60% | 1447 | 0.8 | 187 |
| 8 | 1394 | 1275 | 240 | 188.2 | 45167.3 | 2411 | 4.1 | 975 | 100% | 2411 | 4.1 | 976 |
| 9 | 1159 | 852 | 288 | 104.5 | 30093.4 | 2004 | 2.3 | 654 | 40% | 802 | 0.1 | 19 |
| 10 | 1159 | 1278 | 288 | 156.7 | 45140.0 | 2004 | 2.3 | 654 | 80% | 1604 | 1.1 | 317 |
| 11 | 1159 | 426 | 288 | 52.2 | 15046.7 | 2004 | 2.3 | 654 | 40% | 802 | 0.1 | 19 |
| 12 | 1394 | 1701 | 20 | 250.9 | 5018.6 | 2411 | 4.1 | 81 | 100% | 2411 | 4.1 | 81 |
| 13 | 1394 | 1701 | 196 | 250.9 | 49182.4 | 2411 | 4.1 | 796 | 100% | 2401 | 4.1 | 796 |
| 14 | 1394 | 425 | 216 | 62.7 | 13550.2 | 2411 | 4.1 | 877 | 30% | 723 | 0.0 | 7 |
| 15 | 1629 | 1544 | 20 | 266.2 | 5323.2 | 2817 | 6.6 | 132 | 100% | 2817 | 6.6 | 132 |
| 16 | 1629 | 1544 | 28 | 266.2 | 7452.5 | 2817 | 6.6 | 184 | 100% | 2817 | 6.6 | 184 |
| 17 | 1629 | 386 | 24 | 66.5 | 1597.0 | 2817 | 6.6 | 158 | 30% | 845 | 0.1 | 2 |
| 18 | 1629 | 1158 | 24 | 199.6 | 4790.9 | 2817 | 6.6 | 158 | 50% | 1409 | 0.7 | 17 |
| 19 | 1629 | 772 | 24 | 133.1 | 3193.9 | 2817 | 6.6 | 158 | 50% | 1409 | 0.7 | 17 |
| 20 | 600 | 0 | 22 | 0.0 | 0.0 | 1033 | 0.2 | 5 | 30% | 311 | 0.0 | 0 |
| 21 | 600 | 0 | 142 | 0.0 | 0.0 | 1033 | 0.2 | 33 | 30% | 311 | 0.0 | 0 |
| 22 | 600 | 0 | 10 | 0.0 | 0.0 | 1033 | 0.2 | 2 | 30% | 311 | 0.0 | 0 |

FIG.22

960

| Optimized Variable Speed Water Pump power Calculations | | |
|---|---|---|
| Cycle Average Optimized variable speed pump power (962) | 1.34 | Hp |
| Calculated Variable speed pump power savings (964) | 1.56 | Hp |
| Optimized Variable Speed Power percentage of average engine power (966) | 1.08 | % |
| Cycle Percentage of power saving compared to a conventional pump (968) | 1.25 | % |

FIG.23B

950

| Conventional Pump Power Calculations | | |
|---|---|---|
| Cycle Average Conventional pump power (952) | 2.90 | Hp |
| Cycle average engine power (954) | 124.23 | Hp |
| Conventional Pump Power Percentage of engine power (956) | 2.33 | % |

FIG.23A

VARIABLE SPEED COOLANT PUMP CONTROL STRATEGY

CROSS-REFERENCE TO RELATED APPLICATIONS

The present application claims priority to U.S. Provisional No. 62/817,285, filed Mar. 12, 2019, the entire contents of all of which are herein incorporated by reference.

BACKGROUND

Field of Invention

This disclosure generally relates to variable speed coolant pumps for the cooling systems of vehicle engines, and in particular to such variable speed coolant pumps for commercial ground vehicles, in which the coolant pump speed may be varied in order to improve overall efficiency. Further, it relates to a system and method of controlling variable speed coolant pumps on the basis of actual feedback to the controller concerning the thermodynamic conditions of the cooling system, in order to determine if the variable speed coolant pump is in fact functioning appropriately and protecting the engine, components, and cooling system.

RELATED ART

Internal combustion vehicle engines burn fuel to create useful work, in particular power that is transmitted to the wheels in order to move the vehicle along. In so doing, internal combustion engines create waste heat that must be removed from the engine and certain other vehicle components, in order to maintain the engine and components within their range of operating temperatures and prevent overheating. In order to remove this waste heat, the vast majority of moving ground vehicles use a liquid cooling system, which includes one or more water jackets, cooling galleries, and heat exchangers, in order to transfer heat from the engine and components to the coolant, and one or more radiators to reject heat to the environment. A coolant pump is used to circulate the coolant within the liquid cooling system in order to facilitate rapid and efficient heat transfer from the engine and components to the environment.

The coolant pump requires power from the engine in order to circulate the coolant, and may therefore be characterized as a parasitic load. Not only does this parasitic load lower the overall efficiency of the vehicle powertrain, it also contributes to vehicle emissions by virtue of the additional fuel necessary to create the power consumed by the coolant pump and the resultant additional combustion gases resulting therefrom. Most coolant pumps are driven at a fixed ratio with the engine crankshaft, so that the speed of the coolant pump is directly proportionate to engine speed. This arrangement is based on the presumption that greater cooling capacity is needed at higher engine speeds, and results in greater power consumption by the coolant pump at higher engine speeds.

In order to increase the overall efficiency of the vehicle powertrain and to lower overall vehicle emissions, it is known to use a variable speed coolant pump. In this way, the coolant pump may be operated at a lower speed when engine requirements and operating conditions permit. It is further known to base the speed of the variable speed coolant pump on vehicle speed as determined by a vehicle speed sensor, again based on a presumption that greater cooling capacity is needed at higher vehicle speeds. However, known variable speed coolant pump control systems lack actual feedback to the controller concerning the thermodynamic conditions of the cooling system, in order to determine if the variable speed coolant pump is in fact functioning appropriately and protecting the engine, components, and cooling system. As a result, there is an increased risk that destructive boiling, cavitation, and overheating may occur within certain locations of the engine, components, and cooling system. Conversely, known variable speed coolant pump control systems may unnecessarily operate the variable speed coolant pump at too high of a speed, thereby forfeiting potential savings in fuel, engine efficiency, and overall emissions.

Accordingly, there is an unmet need for a variable speed coolant pump control system and method that provides actual feedback to the controller that determines if the variable speed coolant pump is in fact functioning appropriately and protecting the engine, components, and cooling system.

SUMMARY

According to one embodiment of the system and method of controlling variable speed coolant pumps, a vehicle has an engine and a cooling system. The cooling system includes a cooling circuit, a variable speed coolant pump, and a controller. The controller incorporates measured heat rejection and hydraulic system performance data of the cooling system, and/or is configured to receive from an external source measured heat rejection and hydraulic system performance data of the cooling system. The controller is also configured to calculate coolant flow and pressures at reduced coolant pump speeds, and/or configured to receive from an external source calculated coolant flow and pressures at reduced coolant pump speeds. The controller is also configured to predict coolant temperatures at the reduced water pump speeds, and/or configured to receive from an external source predicted coolant temperatures at the reduced water pump speeds. The controller is also configured to establish a maximum allowable heat flux to avoid boiling of the coolant, and/or configured to receive from an external source an established maximum allowable heat flux to prevent boiling of the coolant. The controller is also configured to optimize the speed of the variable speed coolant pump to prevent the coolant from exceeding the maximum allowable heat flux.

According to another embodiment of the system and method of controlling variable speed coolant pumps, a cooling system of a vehicle having an engine includes a cooling circuit, a variable speed coolant pump, and a controller. The controller incorporates measured heat rejection and hydraulic system performance data of the cooling system, and/or is configured to receive from an external source measured heat rejection and hydraulic system performance data of the cooling system. The controller is also configured to calculate coolant flow and pressures at reduced coolant pump speeds, and/or configured to receive from an external source calculated coolant flow and pressures at reduced coolant pump speeds. The controller is also configured to predict coolant temperatures at the reduced water pump speeds, and/or configured to receive from an external source predicted coolant temperatures at the reduced water pump speeds. The controller is also configured to establish a maximum allowable heat flux to avoid boiling of the coolant, and/or configured to receive from an external source an established maximum allowable heat flux to prevent boiling of the coolant. The controller is also configured to optimize the speed of the variable speed coolant pump to prevent the coolant from exceeding the maximum allowable heat flux.

According to another embodiment of the system and method of controlling variable speed coolant pumps a method of cooling the engine of a vehicle includes several steps. The first step is providing a cooling circuit. The second step is providing a variable speed coolant pump. The third step is incorporating within a controller measured heat rejection and hydraulic system performance data of the cooling system, and/or configuring the controller to receive from an external source measured heat rejection and hydraulic system performance data of the cooling system. The fourth step is configuring the controller to calculate coolant flow and pressures at reduced coolant pump speeds, and/or to receive from an external source calculated coolant flow and pressures at reduced coolant pump speeds. The fifth step is configuring the controller to predict coolant temperatures at the reduced water pump speeds, and/or to receive from an external source predicted coolant temperatures at the reduced water pump speeds. The sixth step is configuring the controller to establish a maximum allowable heat flux to avoid boiling of the coolant and/or to receive from an external source an established maximum allowable heat flux to prevent boiling of the coolant. The seventh step is configuring the controller to optimize the speed of the variable speed coolant pump to prevent the coolant from exceeding the maximum allowable heat flux.

BRIEF DESCRIPTION OF THE DRAWINGS

FIG. 5 is a partial isometric view of an embodiment of a cooling system having a variable speed cooling pump and system for the control thereof, as described herein;

FIG. 6A is a chart of greenhouse gas emissions requirements according to the EPA, as described herein;

FIG. 6B is a graph of sources of greenhouse gas emissions, as described herein;

FIGS. 21A, 21B, 21C, and 21D are charts of conventional coolant pump horsepower demand by speed and load, allowable speed reduction ratio, optimized variable speed coolant pump horsepower demand by speed and load, and coolant power savings as a percentage of conventional pump power demand, respectively, as described herein;

FIG. 22 is a chart of SET cycle coolant pump power calculations, as described herein; and FIGS. 23A and 23B are charts of conventional coolant pump power calculations, and optimized variable speed coolant pump power calculations, respectively, as described herein.

DETAILED DESCRIPTION

Figure 1:
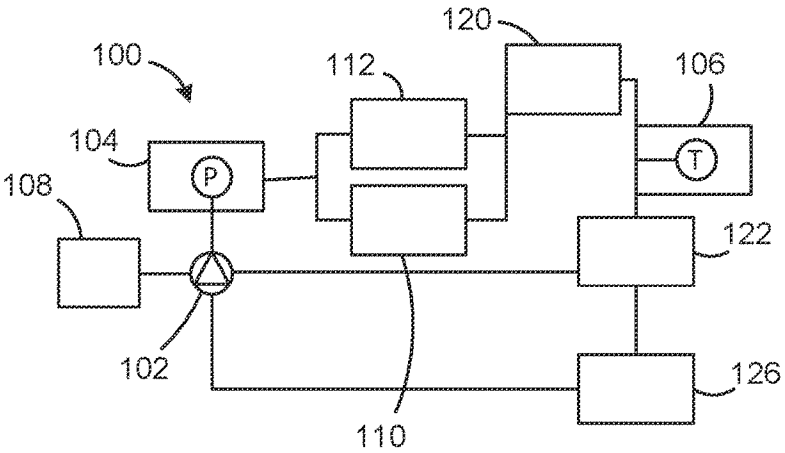
FIG. 1 is a graphical representation of an embodiment of a cooling system having a two speed cooling pump and system for the control thereof, as described herein.

Although necessary for the function of the vehicle powertrain, the coolant pump may be considered a parasitic draw on the engine. Currently, conventional coolant pumps are run with a fixed speed ratio. A variable speed coolant pump can reduce power consumption when performance is not needed. Embodiments described herein relate to a system and method of controlling variable speed coolant pumps on the basis of actual feedback to the controller concerning the thermodynamic conditions of the cooling system, in order to determine if the variable speed coolant pump is in fact functioning appropriately and protecting the engine, components, and cooling system, as stated previously. The system and method of controlling variable speed coolant pumps may be applied to cooling systems of engines used in various types of stationary applications, marine applications, aircraft applications, passenger vehicles, and commercial vehicles and recreational vehicles, such as highway or semi-tractors, straight trucks, busses, fire trucks, agricultural vehicles, construction vehicles, motorhomes, rail travelling vehicles, and etcetera. It is further contemplated that embodiments of the system and method of controlling variable speed coolant pumps may be applied to engines configured for various fuels, such as gasoline, diesel, propane, natural gas, and hydrogen, as non-limiting examples. The several embodiments of the system and method of controlling variable speed coolant pumps presented herein are employed on vehicles utilizing the Otto cycle or the Diesel cycle, but this is not to be construed as limiting the scope of the system and method of controlling variable speed coolant pumps, which may be applied to engines of differing construction.

The system and method of controlling variable speed coolant pumps uses one or more pressure sensors and/or one or more temperature sensors to create a closed loop control system to thereby ensure that the variable speed coolant pump is functioning as intended, while operating at a reduced speed and coolant flow. The system and method of controlling variable speed coolant pumps further analyzes the engine and cooling system operating and/or thermodynamic and/or hydraulic conditions in order to provide improved coolant pump control, while protecting engine hardware and optimizing the fuel savings provided by the variable speed coolant pump. In order to support the implementation of the pressure and/or temperature sensors, and the functionality of the system and method described herein, the system and method of controlling variable speed coolant pumps may use one or more controllers, such as an engine or powertrain controller, configured with coding specific to the component layout of the engine and/or cooling system. This allows the control strategy contained therein to predict when boiling will occur in a component by way of the one or more pressure and/or temperature sensors, and to control the variable speed coolant pump speed to prevent such boiling from occurring while also minimizing the parasitic losses resulting from operation of the coolant pump. In so doing, the system and method of controlling variable speed coolant pumps optimizes the engine cooling system, reduces parasitic losses on the engine, reduces fuel consumption, and supports Environmental Protection Agency Green House Gas emissions requirements.

Turning now to FIG. 1, an embodiment of a system and method of controlling variable speed coolant pumps is provided. The system includes a cooling system 100 having a cooling circuit that includes a coolant pump 102, cooling passages within an engine block 110 and its head 112, an EGR cooler 120, and a radiator 126. Coolant is circulated by the cooling system 100 between the engine block 110, its head 112, the EGR cooler 120, and the radiator 126, in order to remove waste heat from the engine block 110, head 112, and EGR cooler 120. It may be understood that coolant may be circulated through additional vehicle components to absorb or reject heat. A thermostat 122 selectively directs flow of heated coolant from the engine block 110, head 112, and EGR cooler 120 either directly back to the coolant pump 102, or back to the coolant pump 102 by way of the radiator 126, depending on whether sufficient coolant temperature has been achieved to open the thermostat 122. The coolant pump 102 shown in FIG. 1 may be a two speed coolant pump 102.

A controller 108 is connected to, and controls the two speed operation of, the two speed coolant pump 102. The controller 108 is also connected to a pressure sensor 104, in this case located between the two speed coolant pump 102 and the engine block 110 and head 112. The controller 108 is further connected to a temperature sensor 106, in this case located between the EGR cooler 120 and the thermostat 122. The controller 108 controls selection of which of the two speeds of the two speed coolant pump 102 is utilized based on feedback from the pressure sensor 104 and the temperature sensor 106. Based on feedback from the pressure sensor 104, the actual pump speed can be implied or calculated using pump laws, wherein:

$$\Delta P \alpha N^2 (\Delta P = \text{delta pressure}, N = \text{pump shaft speed}).$$

In this way, feedback can be sent to the controller 108 that the two speed coolant pump 102 is functioning correctly. The pump law may be incorporated into the calculation for pressure throughout the cooling system 100.

Figure 2A:
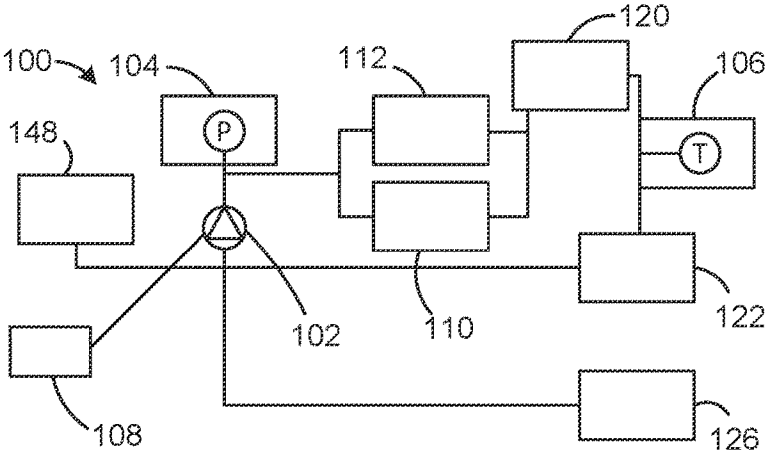
FIG. 2A is a graphical representation of an embodiment of a cooling system having a variable speed cooling pump and system for the control thereof, as described herein.

FIG. 2A shows another embodiment of a system and method of controlling variable speed coolant pumps. The system again includes a cooling system 100 having a cooling circuit that includes a coolant pump 102, cooling passages within an engine block 110 and its head 112, an EGR cooler 120, and a radiator 126. Coolant is again circulated by the cooling system 100 between the engine block 110, its head 112, the EGR cooler 120, and the radiator 126, in order to remove waste heat from the engine block 110, head 112, and EGR cooler 120. It should again be understood that coolant may be circulated through other vehicle components in order to absorb or reject heat from the coolant. The cooling system 100 is further provided with an expansion bottle 148. A thermostat 122 again selectively directs flow of heated coolant from the engine block 110, head 112, and EGR cooler 120 either directly back to the coolant pump 102, or back to the coolant pump 102 by way of the radiator 126, depending on whether sufficient coolant temperature has been achieved to open the thermostat 122. The coolant pump 102 shown in FIG. 2 may be a continuously variable, or incrementally variable, speed coolant pump 102.

Figure 2B:
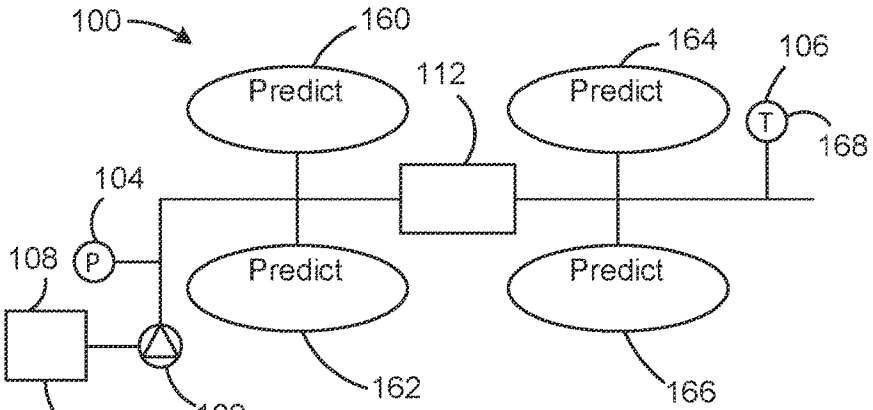
FIG. 2B is a graphical representation of an embodiment of a cooling system having a variable speed cooling pump and system for the control thereof, as described herein.

A controller 108 is again connected to, and controls the continuously variable or incrementally variable speed operation of the coolant pump 102. The controller 108 is again connected to a pressure sensor 104 located between the continuously variable or incrementally variable speed coolant pump 102 and the engine block 110 and head 112. The controller 108 is again connected to a temperature sensor 106 located between the EGR cooler 120 and the thermostat 122. The controller 108 again controls the speed of the continuously variable or incrementally variable speed coolant pump 102 based on feedback from the pressure sensor 104 and the temperature sensor 106. The controller 108 uses feedback from the pressure sensor 104 and/or from the temperature sensor 106 to predict boiling of the coolant at various points in the engine block 110, head 112, or EGR cooler 120, as non-limiting examples. As illustrated in FIG. 2B, the controller 108 may, for non-limiting example, control the speed of the continuously variable or incrementally variable speed coolant pump 102 using feedback from the pressure sensor 104 and/or from the temperature sensor 106 to predict boiling of the coolant. The controller 108 may accomplish this by predicting the pressure 160 and temperature 162 before the coolant enters the head 112, and/or by predicting the pressure 164 and temperature 166 after the coolant exits the head 112.

Figure 3:
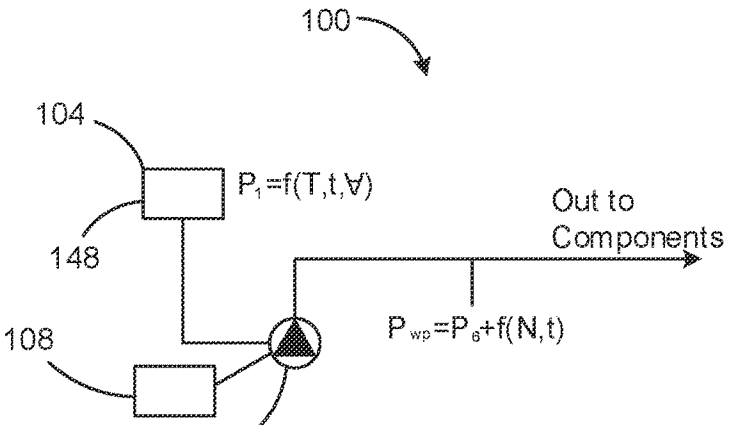
FIG. 3 is a graphical representation of an embodiment of a cooling system having a variable speed cooling pump and system for the control thereof, as described herein.

As shown in FIG. 3, then, the controller 108 may use information, for example, from a pressure sensor 104 located in the expansion bottle 148 to derive and predict pressures and temperatures at different points in the cooling system 100. The controller 108 may derive and predict pressures at different points in the cooling system 100 as a function of temperature (T), saturation temperature (t), and shaft speed (N), all else being equal (∀):

$$PX=f(T,t,\forall)$$

$$P\omega\rho=PX+f(N,t)$$

The controller 108 can then determine if boiling will occur within the cooling system 100, and then change the coolant pump 102 operating mode to prevent boiling from happening based on the saturation temperature. As pressure varies in the cooling system 100 based on the expansion bottle 148 pressure, so this pressure sensor may be required to accurately predict boiling.

Figure 4:
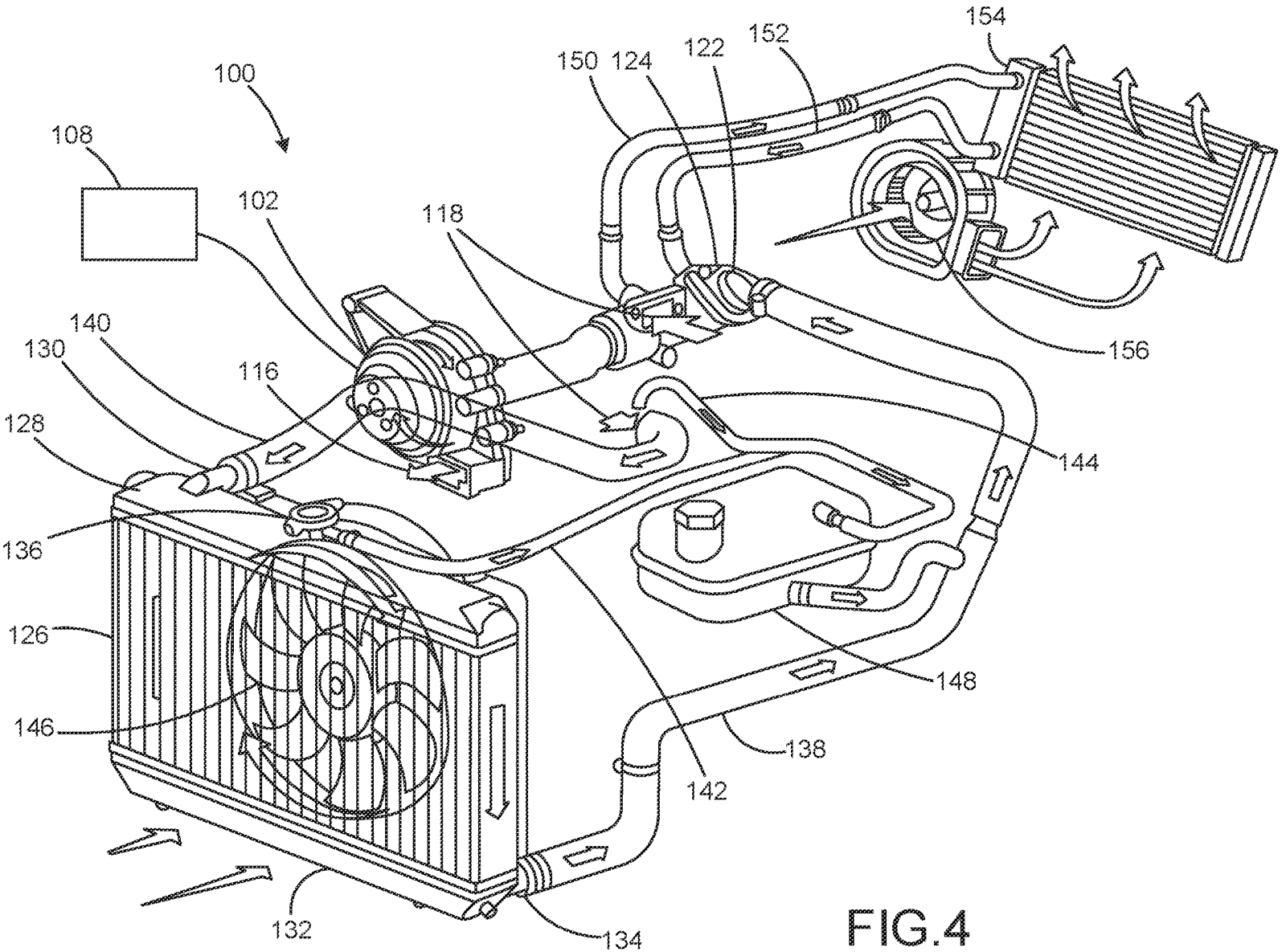
FIG. 4 is a partial isometric view of an embodiment of a cooling system having a variable speed cooling pump and system for the control thereof, as described herein.

Turning now to FIGS. 4 and 5, additional embodiments of cooling systems 100 that may implement a system and method of controlling variable speed coolant pumps 200 is shown. The cooling system 100 has a cooling circuit that includes a variable speed coolant pump 102, cooling passages within an engine block 110 or crankcase 114, and its head 112 (not shown in FIG. 4), an EGR cooler 120 (not shown in FIG. 4), and a radiator 126. The radiator 126 is provided with a radiator cap 136, a radiator top tank 128 with a radiator inlet 130, and a radiator bottom tank 132 with a radiator outlet 134. Coolant is circulated by the cooling system 100 between the engine block 110 or crankcase 114, its head 112, the EGR cooler 120, and the radiator 126, in order to remove waste heat from the engine block 110 or crankcase 114, head 112, and EGR cooler 120. As before, it may be understood that coolant may be circulated through additional vehicle components or heat exchangers to absorb or reject heat. A thermostat 122 arranged in a thermostat housing 124 selectively directs flow of heated coolant from the engine block 110 and head 112 either directly back to the variable speed coolant pump 102, or back to the coolant pump 102 by way of the radiator 126, depending on whether sufficient coolant temperature has been achieved to open the thermostat 122. A controller 108 is connected to, and controls the speed of, the variable speed coolant pump 102.

When the thermostat 122 is closed, coolant is pumped by the variable speed coolant pump 102 into an engine coolant inlet 116, travels through the cooling galleries of the engine block 110 and its head 112, and returns to the variable speed coolant pump 102 by way of an engine coolant outlet 118 adjacent to the thermostat housing 124. When the thermostat is open, coolant is pumped by the variable speed coolant pump 102 into the engine coolant inlet 116, travels through the cooling galleries of the engine block 110 and its head 112, and exits an engine coolant outlet 118 to an upper radiator hose 140 leading to the radiator inlet 130. The coolant travels through the radiator 126 to the radiator outlet 134, through a lower radiator hose 138, to the thermostat 122, and back to the variable speed coolant pump 102. As it travels through the radiator 126, the coolant rejects heat to the environment, which may be assisted by way of a cooling fan 146.

In order to provide expansion volume for the coolant as it is heated by the engine, the cooling system 100 may include an expansion bottle 148, which is in fluid communication with the lower radiator hose 138. Further, to provide for deaeration of the coolant, the expansion bottle 148 may be connected to the radiator top tank 128 by way of a radiator bleed hose 142, and to the top of the engine by way of a steam hose 144. In order to provide heat to occupants of the vehicle, the cooling system 100 may further include a heater core 154 and a heater fan 156. The heater core 154 is connected to the cooling system 100 using a heater feed hose 150 and a heater return hose 152. The primary function of the cooling system 100 is to remove waste heat from the engine block 110, crankcase 114, head 112, EGR cooler 120, and any other vehicle component or heat exchanger to which it connects, and to reject the waste heat to the environment by way of the radiator 126 and/or to the occupants of the vehicle by way of the heater core 154. In so doing, the cooling system 100 maintains acceptable metal surface temperatures and lubrication system temperatures, as well as improving engine efficiency and reducing vehicle emissions by way of air management temperature control.

As shown in FIG. 6A, among other things, the need for improved engine efficiency and reduced vehicle emissions is largely driven by the U.S. Environmental Protection Agency making more stringent Carbon Dioxide (greenhouse gas) emissions regulations. As shown in FIG. 6B, by the year 2020, on-road vehicles will still be the number one source of greenhouse gas emissions in the U.S. As noted previously, although necessary for the function of the vehicle powertrain, the coolant pump may be considered a parasitic draw on the engine. Currently, conventional coolant pumps are run with a fixed speed ratio. A variable speed coolant pump 102 can reduce power consumption when performance is not needed.

Figure 7:
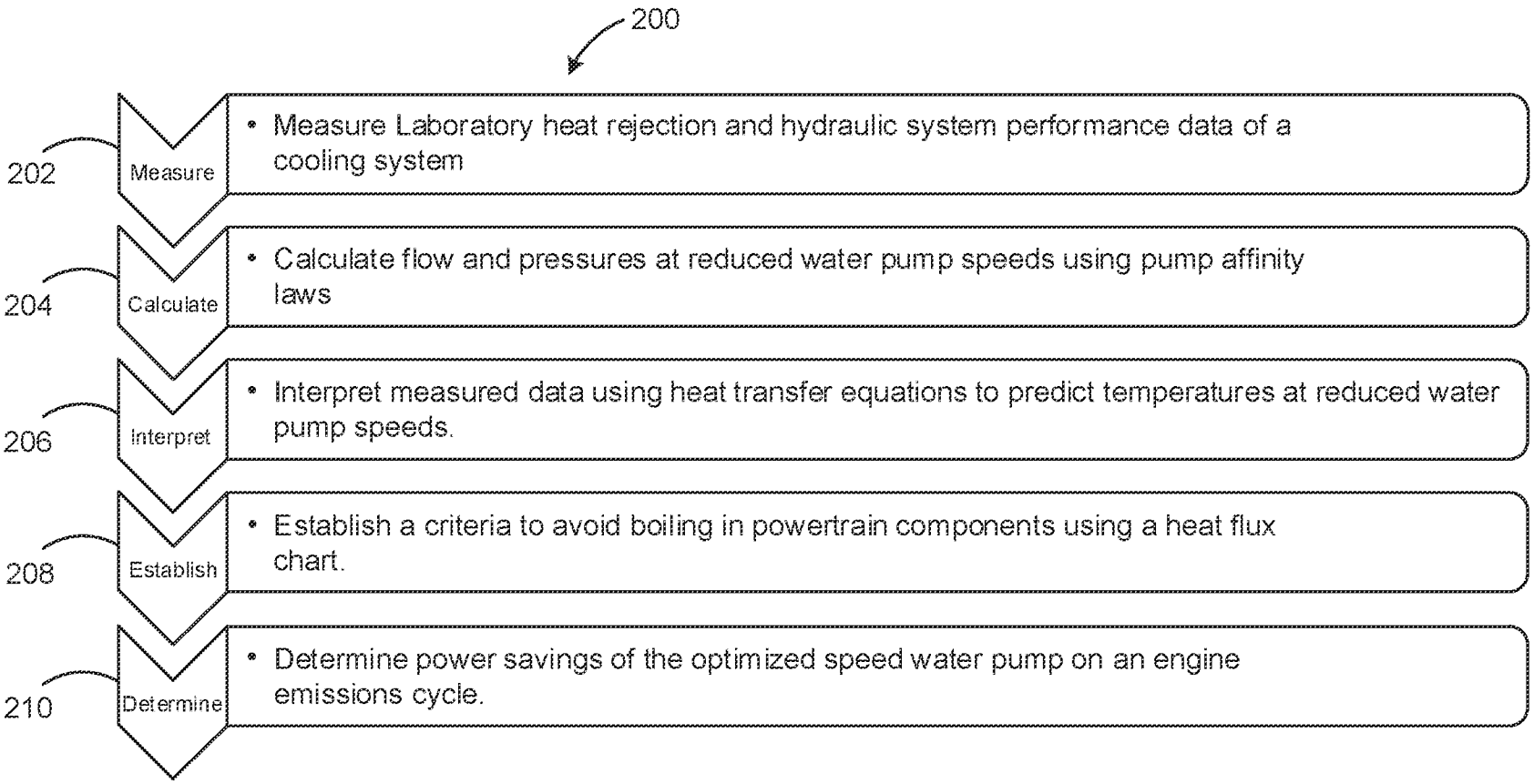
FIG. 7 is a graphical representation of phases of an embodiment of a system and method for controlling a variable speed cooling pump of a cooling system, as described herein.

As shown in FIG. 7, the system and method 200 of controlling variable speed coolant pumps may involve five steps. The first or measurement step 202 includes measuring laboratory heat rejection and hydraulic system performance data of a cooling system 100 of a given configuration. This information may then be incorporated within the controller 108, or may be otherwise communicated to the controller 108. The second or calculation step 204 includes calculating flow and pressures at reduced water pump speeds using pump affinity laws, which may be performed by the controller 108, or may be performed externally and communicated to the controller 108. The third or interpretation step 206 includes interpreting the measured data using heat transfer equations to predict temperatures at the reduced water pump speeds, which may be performed by the controller 108, or may be performed externally and communicated to the controller 108. The fourth or establishment step 208 includes establishing a criteria to avoid boiling in powertrain components using a heat flux graph, which may be performed by the controller 108, or may be performed externally and communicated to the controller 108. This criteria may be a maximum allowable heat flux to prevent boiling, and/or a variable speed coolant pump speed required to stay below the maximum allowable heat flux. The fifth or determination step 210 includes determining power savings of the optimized speed coolant pump on an engine emissions cycle, which may be performed by the controller 108, or may be performed externally and communicated to the controller 108.

Figure 8:
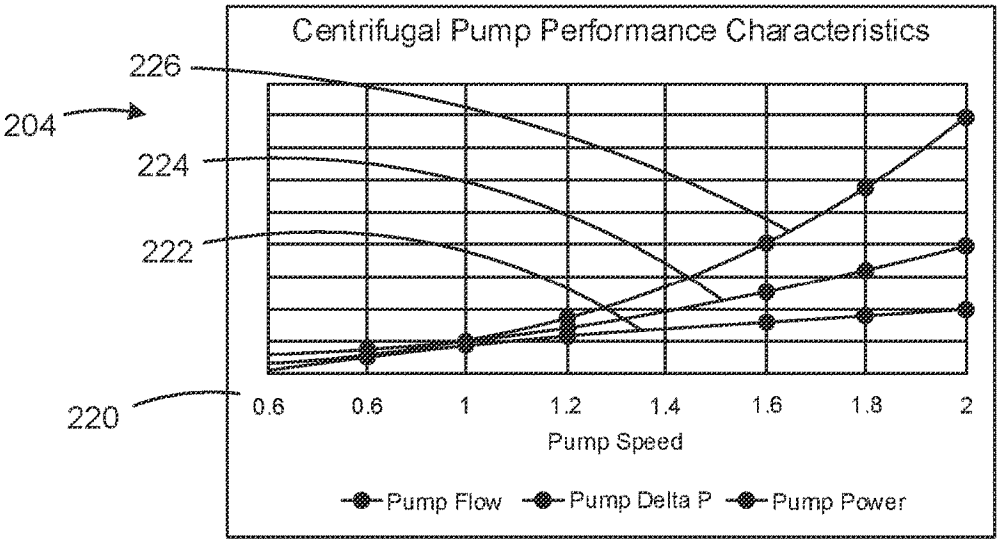
FIG. 8 is a graph of variable speed cooling pump volumetric flow rate, head pressure, and power as functions of the speed of an embodiment of a variable speed cooling pump, as described herein.

As shown in FIG. 8, the second or calculation step 204, which again includes calculating flow and pressures at reduced variable speed coolant pump 102 speeds using pump affinity laws, in which:

Volumetric flow rate 222 is linear to pump speed 220: $\dot{V}_1/\dot{V}_2=\omega_1/\omega_2$ Head pressure 224 is a squared function of pump speed 220: $\Delta P_1/\Delta P_2=(\omega_1/\omega_2)^2$ Pump power 226 is a cubic function of pump speed 220: $Hp_1/Hp_2=(\omega_1/\omega_2)^3$ These Pump Affinity laws apply to centrifugal pumps such as the variable speed coolant pump 102. The Pump Affinity laws can be used to accurately predict the thermodynamic effects when the variable speed coolant pump 102 speed is changed, to predict the change in variable speed coolant pump 102 speed when the thermodynamic effects are known. The second or calculation step 204 may again be performed by the controller 108, or may be performed externally and communicated to the controller 108.

Figure 9:
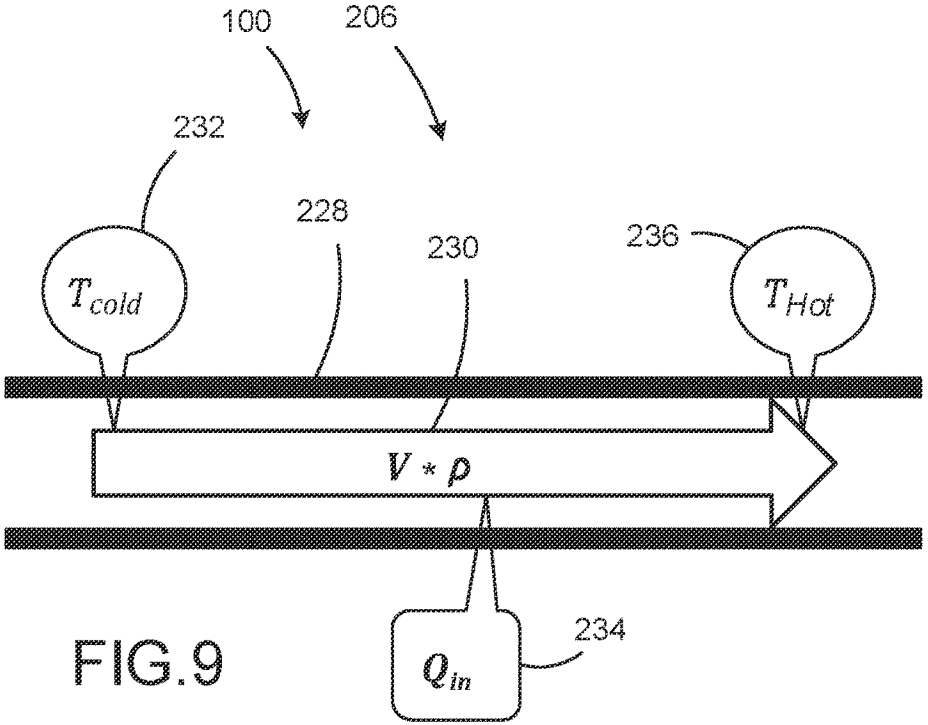
FIG. 9 is a graphical representation of fluid flow in a pipe undergoing heat transfer, as described herein.

As shown in FIG. 9, the third or interpret step 206 again includes interpreting the measured data using heat transfer equations to predict temperatures at the reduced variable speed coolant pump 102 speeds. In this step, convective heat transfer equations are used to predict temperatures throughout the cooling system 100. Specific heat capacity and fluid densities are measured empirically. System components are modeled using pipe flow behavior. FIG. 9 shows, for example, a representative pipe 228, in which fluid flow 230 is represented as V×p, and wherein V is volumetric flow rate and ρ is fluid density. The cold temperature 232 is represented as $T_{cold}$. Heat in 234 is represented as $Q_{in}$. The hot temperature 236 is represented as $T_{hot}$. The convective heat transfer equations are used to predict temperatures throughout the cooling system 100 are:

$$Q_{in}=Cp\times\dot{V}\times\rho\times\Delta T$$

$$\Delta T=T_{hot}-T_{cold}$$

Wherein Cp is specific heat capacity. The third or interpret step 206 may again be performed by the controller 108, or may be performed externally and communicated to the controller 108.

Figure 10:
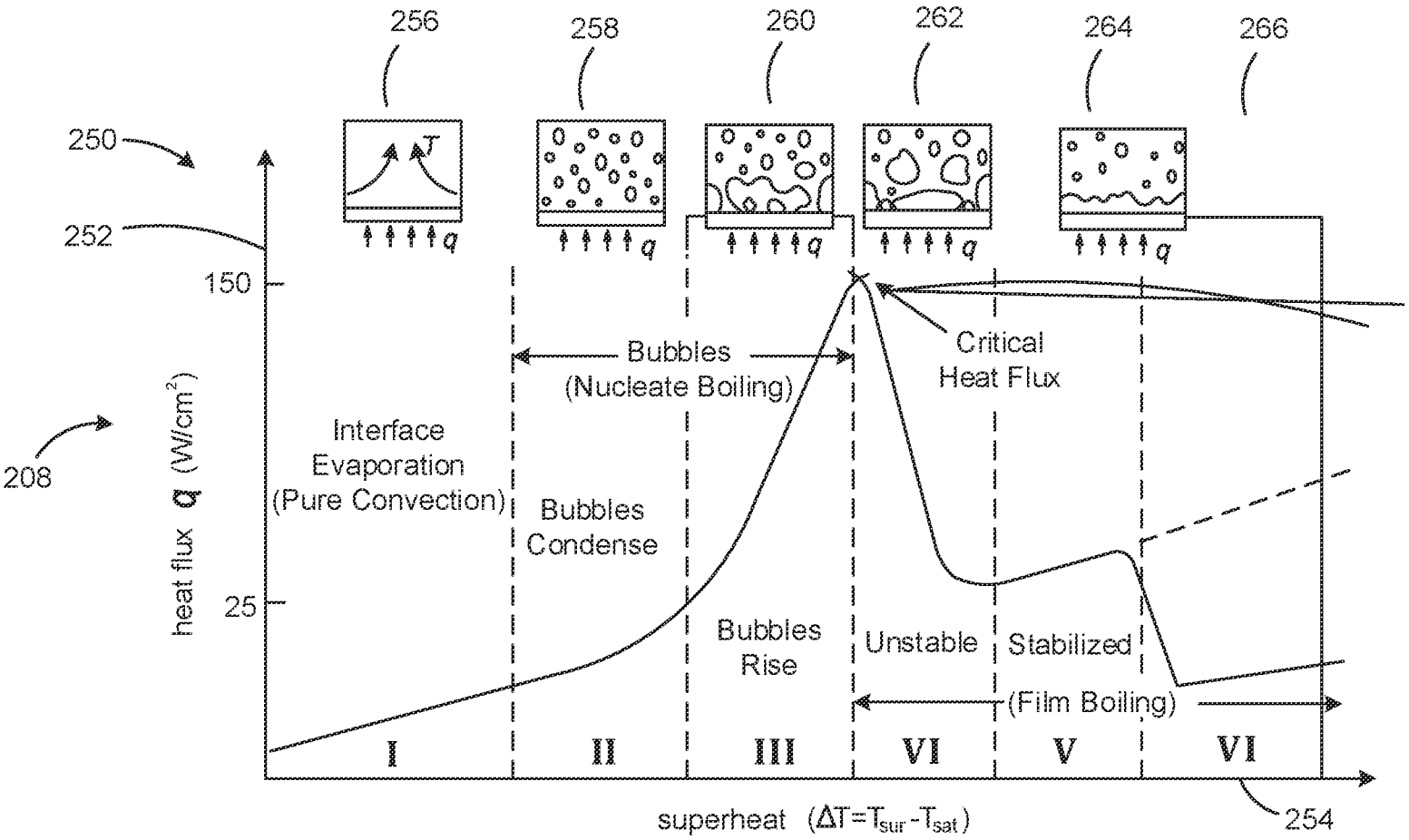
FIG. 10 is a graph of heat flux according to regions of boiling behavior, as described herein.

As shown in FIG. 10, the fourth or establishment step 208 again includes establishing a criteria to avoid boiling in powertrain components using a heat flux graph 250. As noted previously, this criteria may be a maximum allowable heat flux to prevent boiling, and/or a variable speed coolant pump speed required to stay below the maximum allowable heat flux. As shown in the heat flux graph 250, heat flux is plotted with the heat flux axis 252 arranged vertically and the superheat axis 254 arranged horizontally. Six regions of boiling characteristics appear wherein:

Region I is characterized by interface evaporation pure convection 256,

Region II is characterized by nucleate boiling bubbles condensing 258,

Region III is characterized by nucleate boiling bubbles rising 260,

Region IV is characterized by unstable film boiling 262,

Region V is characterized by stabilized film boiling 264, and

Region VI is characterized by stabilized boiling 266.

Critical heat flux 268 occurs at the interface of region III and region IV. In region I and in region II, heat flux is safe, predictable, and controllable. In region III, change in heat flux occurs quickly and is difficult to control. In region IV, the development of a gas layer causes temperatures to rise, and heat flux to fall.

In the fourth or establishment step 208 step, therefore, assumptions are made to remain within region I in the heat flux graph 250. Boiling point analysis is completed using the Antoine Equation for vapor pressure, which is then solved for temperature:

$$LOG_{10}(P)=A-(B/(C+T))$$

$$T=(B/(A-LOG_{10}(P)))-C$$

Component specific coefficients for 50/50 mix by weight ethylene glycol and water are:

$$A=7.901,$$

$$B=1691.452, \text{ and}$$

$$C=229.778$$

The fourth or establishment step 208 may again be performed by the controller 108, or may be performed externally and communicated to the controller 108.

The fifth or determination step 210, again includes determining power savings of the optimized speed coolant pump on an engine emissions cycle. The fifth or determination step 210 therefore utilizes the Bernoulli Head Equation, wherein pump geometry is considered to be fixed and height changes are considered to be negligible:

$$H=((P/(\rho\times g))++)_{out}-((P/(\rho\times g))++)_{in}\rightarrow$$

$$H=(P_{out}-P_{in})/(\rho\times g)$$

Wherein H represents pump head, $\dot{V}$ represents volumetric flow rate, p represents fluid density, g represents the gravity constant, Z represents height, ω represents shaft speed, $T_{Shaft}$ represents Torque, and $\dot{W}$ represents power. Hydraulic horsepower is then calculated according to:

$$W_{Pump}=\rho\times g\times\dot{V}\times H$$

Mechanical horsepower is then calculated according to:

$$W_{Shaft}=\omega\times T_{Shaft}$$

Finally, pump efficiency is then calculated according to:

$$\eta_{Pump}=\dot{W}_{Pump}/\dot{W}_{Shaft}=(\rho\times g\times\dot{V}\times H)/(\omega\times T_{Shaft})$$

The fifth or determination step 210 may again be performed by the controller 108, or may be performed externally and/or communicated to the controller 108.

Figure 11:
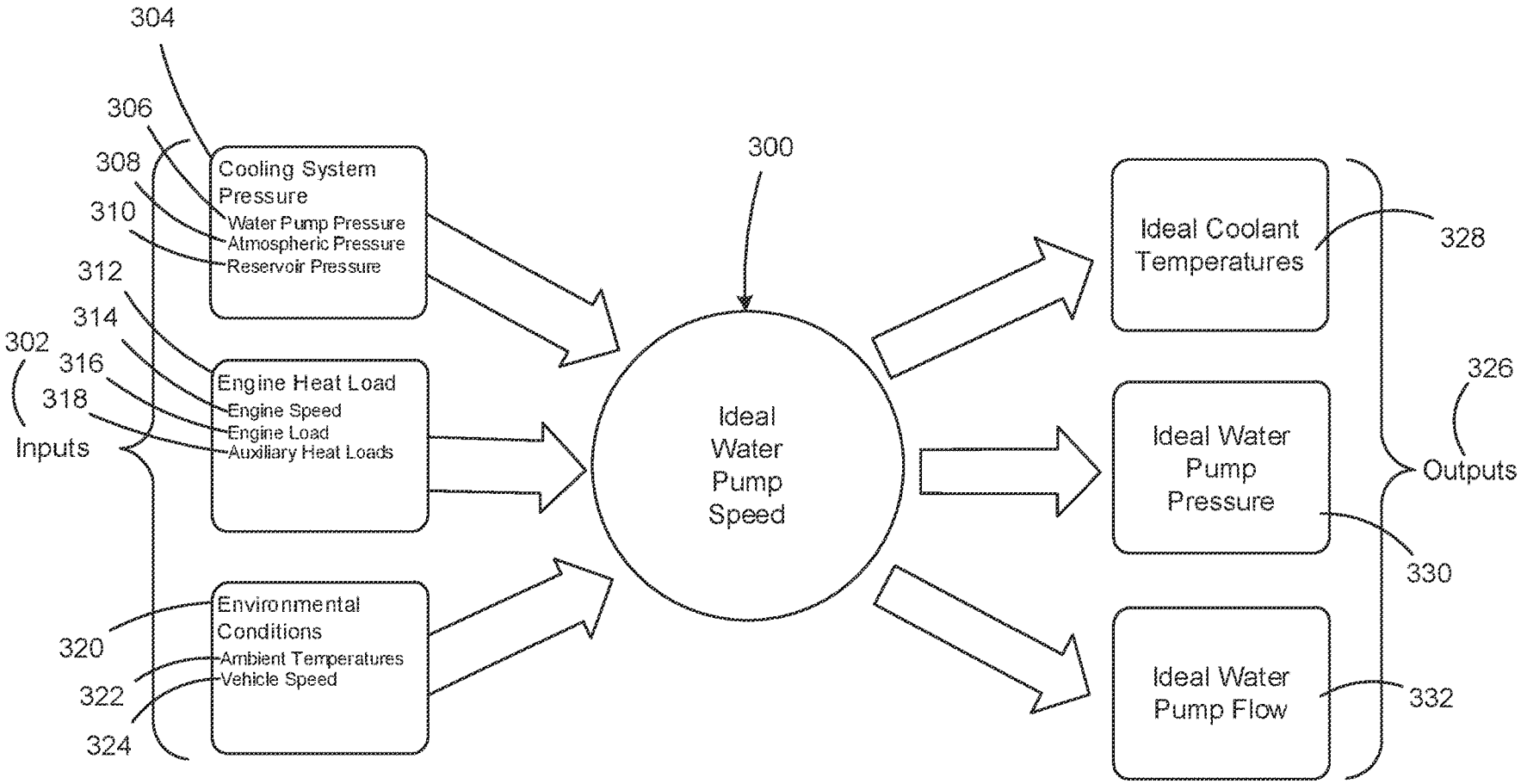
FIG. 11 is a graphical representation of inputs and outputs of an embodiment of a system and method for controlling a variable speed cooling pump of a cooling system as a function of the ideal water pump speed, as described herein.

FIG. 11 is a graphical representation of how an embodiment of a system and method of controlling variable speed coolant pumps 102 may use certain inputs 302 to establish an ideal coolant pump speed 300 resulting in certain outputs 326, including ideal coolant temperatures 328, ideal coolant pump pressures 330, and ideal coolant pump flow 332. The inputs 302 may include cooling system pressure 304, coolant pump pressure 306, atmospheric pressure 308, reservoir pressure 310, engine heat load 312, engine speed 314, engine load 316, auxiliary heat loads 318, environmental conditions 320, ambient temperatures 322, and/or vehicle speed 324, as non-limiting examples. The ideal coolant pump speed 300 is that which is necessary to create the ideal coolant pump flow 332, according to the second or calculation step 204 using data from the first or measurement step 202. The ideal coolant pump flow 332 is that which is necessary to just allow the maximum allowable heat flux according to the third or interpretation step 206 using data from the first or measurement step 202. The ideal coolant temperatures 328 and ideal coolant pump pressures 330 are those that are necessary to just remain within the maximum allowable heat flux to prevent boiling established in the fourth or establishment step 208.

Figure 12:
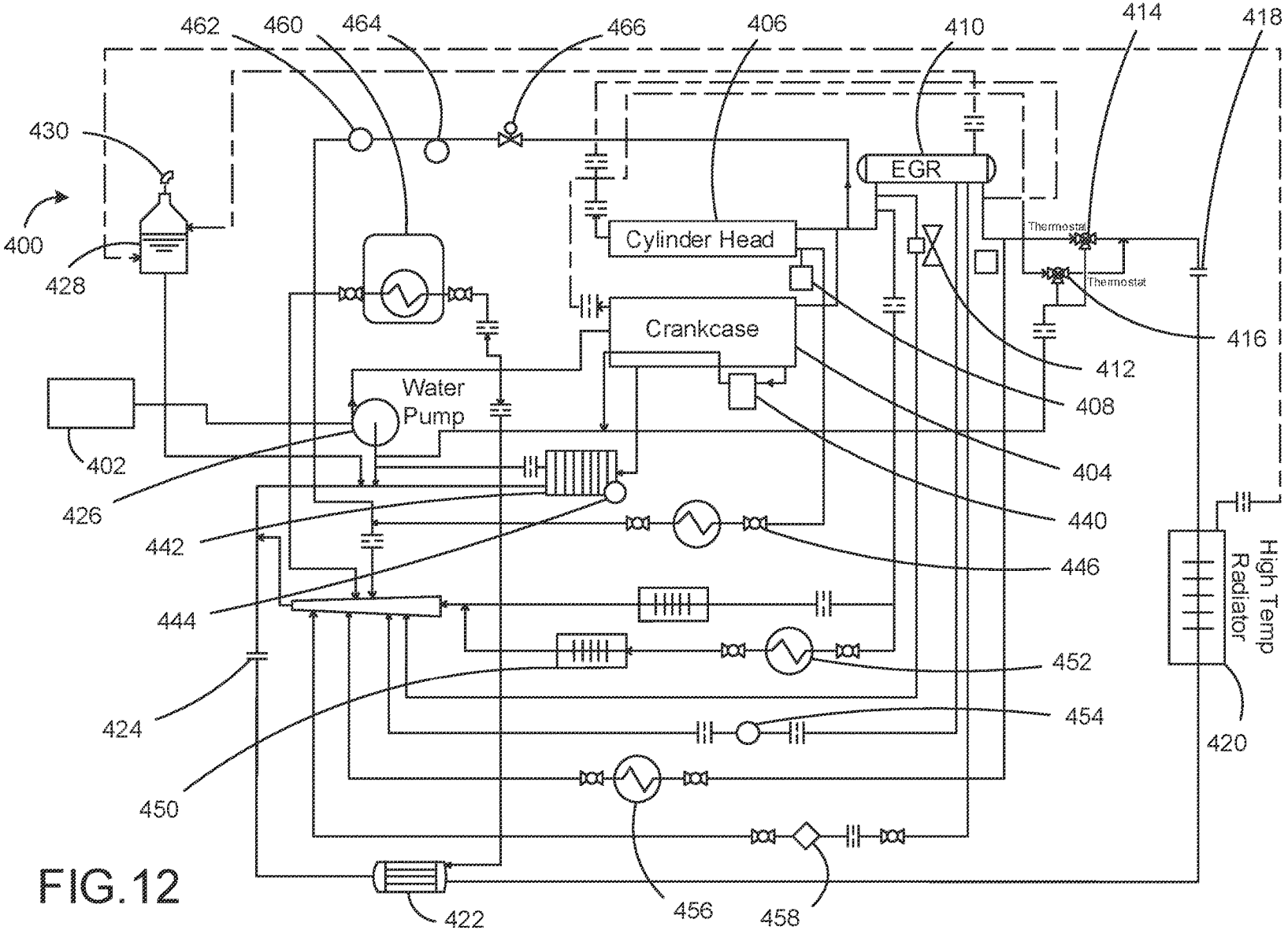
FIG. 12 is a diagram of an embodiment of a cooling system that may be used in conjunction with a variable speed cooling pump and a system and method for the control thereof, as described herein.

FIG. 12 shows an additional embodiment of a cooling system 400 that may implement a system and method of controlling a variable speed coolant pump 426. The cooling system 400 again has a cooling circuit that includes a variable speed coolant pump 426, cooling passages within a crankcase 404 and a cylinder head 406, an EGR cooler 410, and a high temperature radiator 420. Operation of the EGR cooler 410 may be controlled using an EGR valve 412. Circulation of the coolant may be controlled by a first thermostat 414 and/or a second thermostat 416. The cooling circuit may further be provided with an auxiliary cooler 422. In order to provide expansion volume for the coolant as it is heated by the engine, a surge tank 428 may be provided, and may have a surge tank cap 430, which may or may not be provided with a pressure relief valve. In passing into and out of the engine assembly, coolant may pass through an engine inlet joint 424 and an engine outlet joint 418. Additional items may be included in the cooling circuit of the cooling system 400, such as an oil cooler 442 having an electric oil cooler heating element 444, an auxiliary component 440 such as an auxiliary power unit 446, a first heater core 448 and/or a second heater core 450 having a heater core electric heater 452, one or more actuators 454, an auxiliary coolant heater 456, a coolant filter 458, one or more auxiliary heaters 460, a module 462, a heater 464, and/or a control valve 466. A controller 402 configured to implement the system and method of controlling a variable speed coolant pump 426 may be provided, and may obtain information from one or more temperature or pressure sensors 408.

Figure 13:
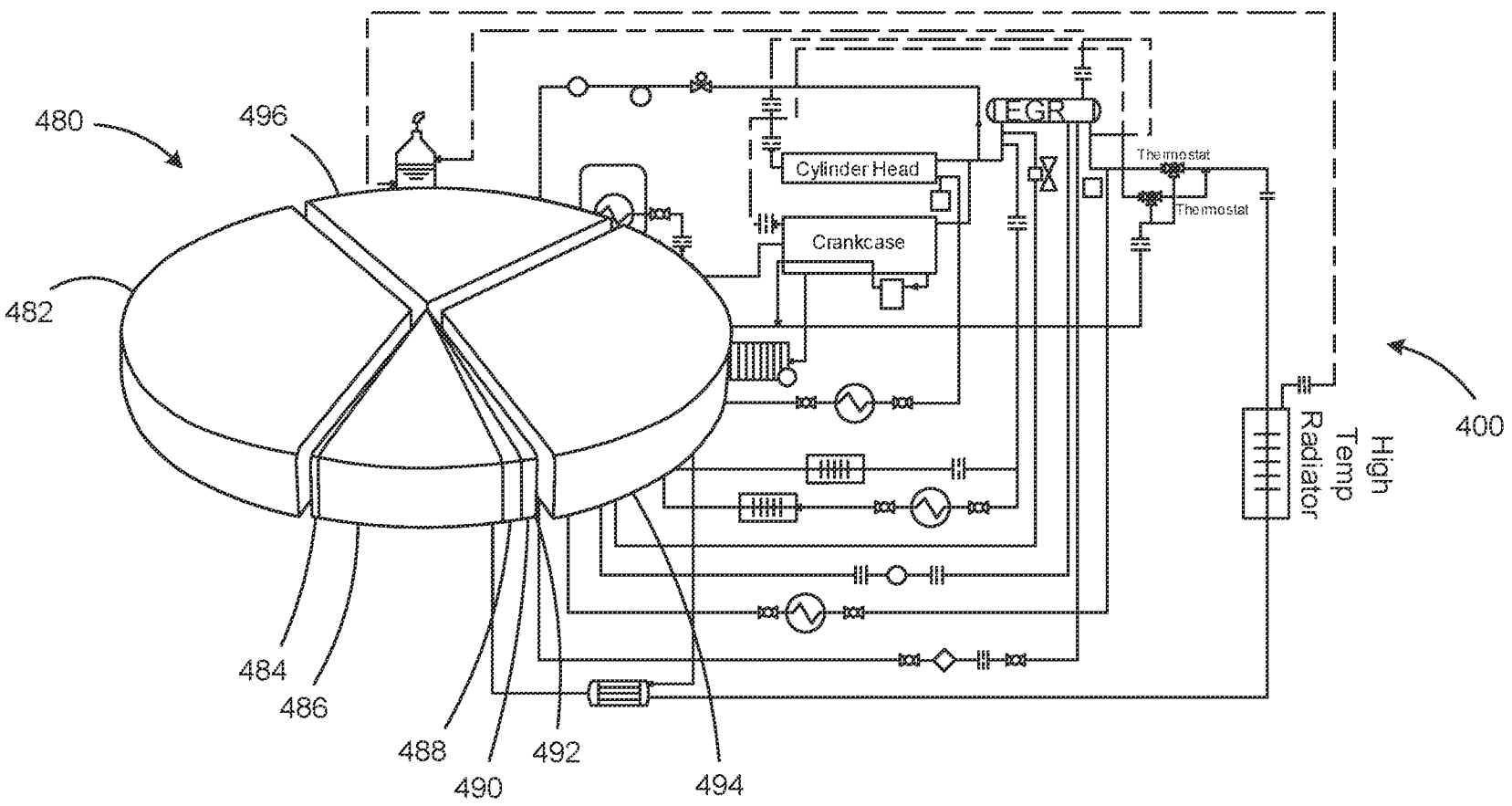
FIG. 13 is a diagram of an embodiment of a cooling system that may be used in conjunction with a variable speed cooling pump and a system and method for the control thereof, and a graph of heat input to the cooling system, as described herein.

FIG. 13 shows a heat input to coolant graph 480 superimposed over the cooling system 400, in which 89% of heat transferred in BTU per minute to the coolant comes from three components:

Total head heat rate 482 is 36.5%;

EGRV Heat Rate 490 is 32.0%; and

Total Crankcase Heat Rate 496 is 20.5%.

The remaining 11% of heat transferred to the coolant comes from, in descending order:

Oil cooler heat rate 486 is 8.9%;

Air Compressor Heat Rate 488 is 0.9%;

EGRC Heat Rate 494 is 0.7%;

VGT actuator heat rate 484 is 0.4%; and

HC Doser Heat Rate 492 is 0.2%.

Figure 14D:
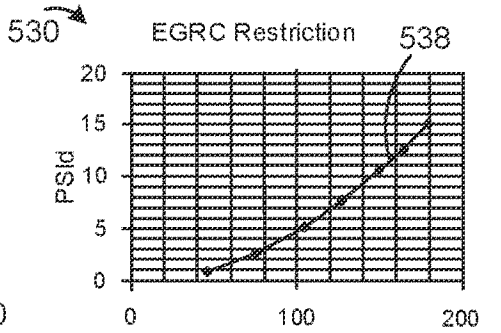
FIGS. 14B through 14E are graphs of component hydraulic restrictions, as described herein.
Figure 14E:
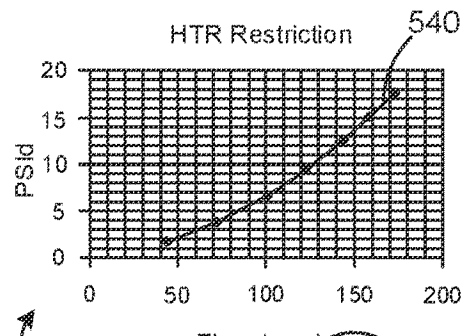
Figure 14A:
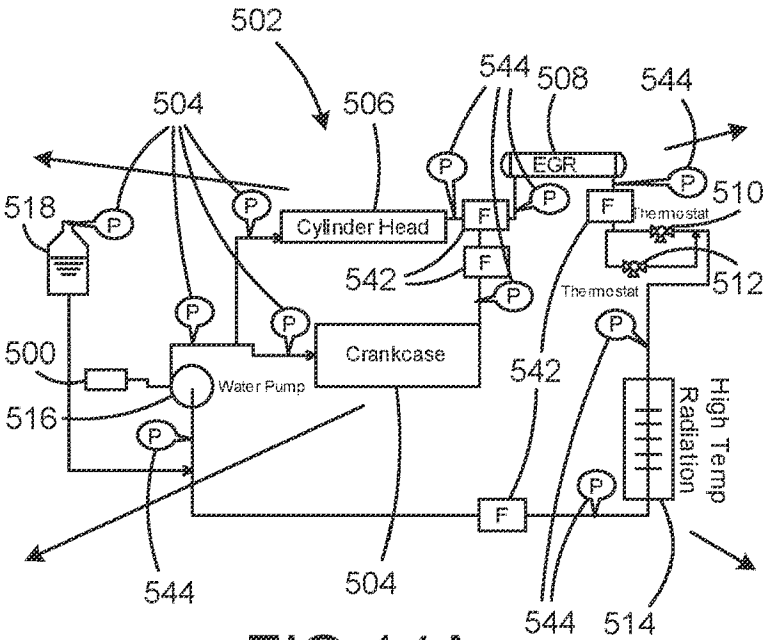
FIG. 14A is an embodiment of a cooling system having a variable speed cooling pump and system and method for the control thereof, as described herein.
Figure 14B:
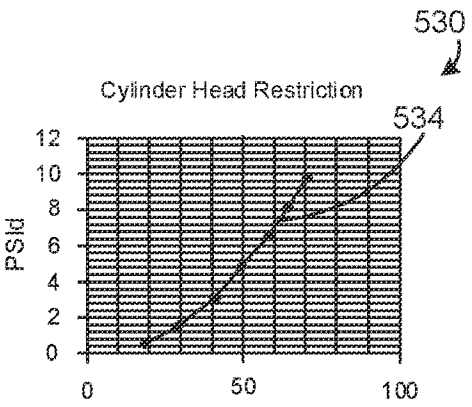
Figure 14C:
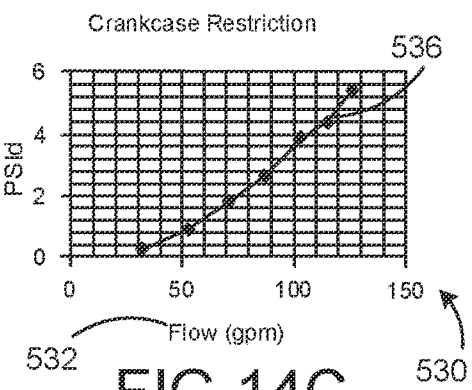

FIGS. 14A through 14E show component hydraulic restrictions 530 that may be used in the first or measurement step 202 that includes measuring laboratory heat rejection and hydraulic system performance data of a cooling system 502 of a given configuration, and in the second or calculation step 204 that includes calculating flow and pressures at reduced variable speed coolant pump 516 speeds, as well as in the fifth or determination step 210 that includes determining power savings of the optimized variable speed coolant pump 516 on an engine emissions cycle. Specifically, the component hydraulic restrictions 530 are necessary in order to model the cooling system 502 behavior. FIG. 14A illustrates an embodiment of a cooling system 502 for which the component hydraulic restrictions 530 are obtained as part of the system and method of controlling a variable speed coolant pump 516. The cooling system 502 again has a cooling circuit that includes a variable speed coolant pump 516, cooling passages within a crankcase 504 and cylinder head 506, an EGR cooler 508, a high temperature radiator 514, a first thermostat 510, a second thermostat 512, and a surge tank 518. A controller 500 controls the speed of the variable speed coolant pump 516. FIGS. 14B, 14C, 14D, and 14E, then, show cylinder head restriction 534, crankcase restriction 536, EGRC restriction 538, and heater restriction 540, respectively, as a function of coolant flow 532. This information may be used to solve for variable speed coolant pump 516 power:

$$W_{Pump}=\rho\times g\times\dot{V}\times H=\dot{V}\times\Delta P$$

Measured flow 542, measured pressure 544, and measured temperature 546 may be obtained directly from the cooling system 502

Figure 15D:
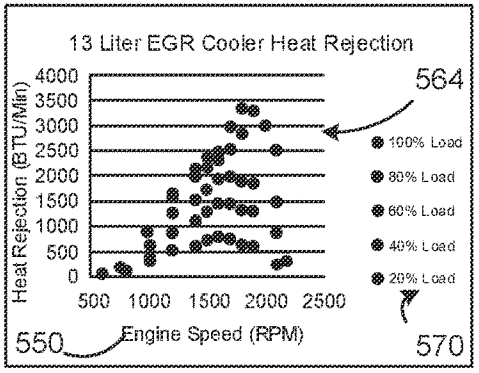
FIGS. 15B through 15E are graphs of component heat rejections, as described herein.
Figure 15E:
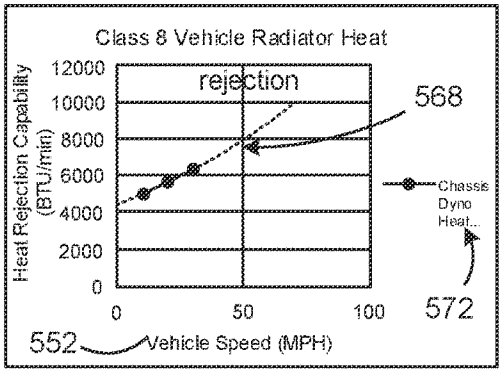
Figure 15A:
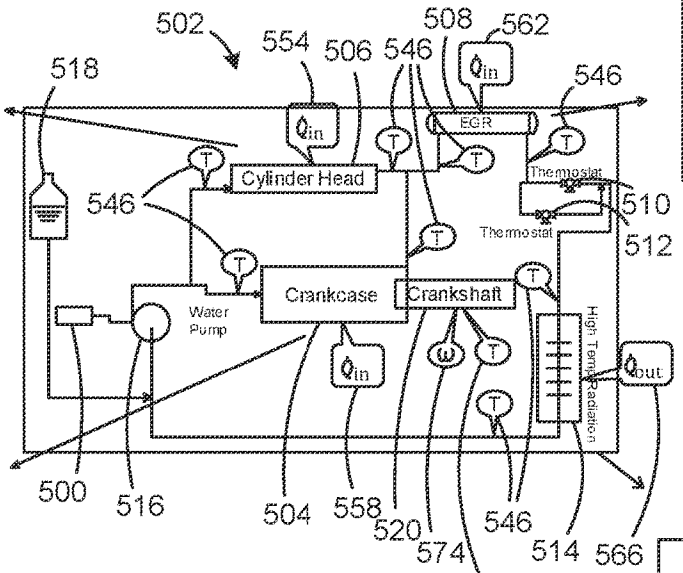
FIG. 15A is an embodiment of a cooling system having a variable speed cooling pump and system and method for the control thereof, as described herein.
Figure 15B:
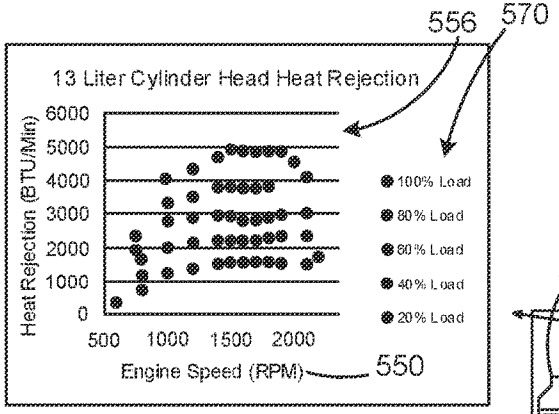
Figure 15C:
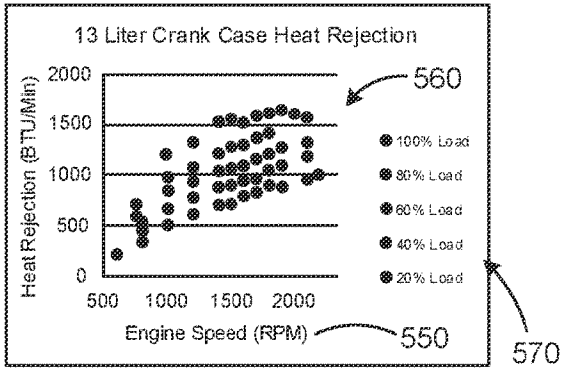

FIG. 15A again shows an embodiment of a cooling system 502 for which the powertrain heat rejection data at various engine speeds and loads are obtained as part of the system and method of controlling a variable speed coolant pump 516. The cooling system 502 again has a cooling circuit that includes a variable speed coolant pump 516, cooling passages within a crankcase 504 and cylinder head 506, an EGR cooler 508, a high temperature radiator 514, a first thermostat 510, a second thermostat 512, and a surge tank 518. A controller 500 controls the speed of the variable speed coolant pump 516. The cylinder head 506 creates a cylinder head heat input 554, the crankcase 504 creates a crankcase heat input 558, the EGR cooler 508 creates an EGR cooler heat input 562, and the high temperature radiator 51 creates a vehicle radiator heat output 566. FIGS. 15B, 15C, and 15D, then, show cylinder head heat rejection 556 to the cooling system 502, crankcase heat rejection 560 to the cooling system 502, and EGR cooler heat rejection 564 to the cooling system 502, respectively, as a function of engine speed 550 and engine load 570. FIG. 15E, then, shows vehicle radiator heat rejection 568 to the environment, or chassis dyno heat rejection 572, as a function of vehicle speed 552.

Measured temperature 546 may be obtained directly from the cooling system 502. Engine speed and load may be obtained from measured crankshaft 520 angular velocity 574 and measured crankshaft 520 torque 576. The cylinder head heat rejection 556 to the cooling system 502, crankcase heat rejection 560 to the cooling system 502, EGR cooler heat rejection 564 to the cooling system 502, and vehicle radiator heat rejection 568 to the environment may be determined using:

$$Q_{in}=Cp\times\dot{V}\times\rho\times\Delta T$$

The cylinder head heat rejection 556 to the cooling system 502, crankcase heat rejection 560 to the cooling system 502, EGR cooler heat rejection 564 to the cooling system 502, and vehicle radiator heat rejection 568 to the environment may be used in the first or measurement step 202 that includes measuring laboratory heat rejection and hydraulic system performance data of a cooling system 100 of a given configuration, the third or interpretation step 206 that includes interpreting the measured data using heat transfer equations to predict temperatures at the reduced water pump speeds, as well as in the fourth or establishment step 208 that includes establishing a criteria to avoid boiling in powertrain components using a heat flux graph. Specifically, as shown in FIG. 11, the system and method of controlling a variable speed coolant pump 516 may use this information to increase flow rates when heat input increases, in order to just allow the maximum allowable heat flux to prevent boiling, and conversely to decrease flow rates when heat input decreases, in order to minimize power draw and to maximize efficiency of the variable speed coolant pump 516.

FIG. 16A again shows an embodiment of a cooling system 502 for which the powertrain heat rejection data at various engine speeds and loads are obtained as part of the system and method of controlling a variable speed coolant pump 516. The cooling system 502 again has a cooling circuit that includes a variable speed coolant pump 516, cooling passages within a crankcase 504 and cylinder head 506, an EGR cooler 508, a high temperature radiator 514, a first thermostat 510, a second thermostat 512, and a surge tank 518. A controller 500 controls the speed of the variable speed coolant pump 516. Measured coolant pump angular velocity 578 and measured coolant pump torque 580 are used to determine engine coolant pump performance 582.

Figure 16C:
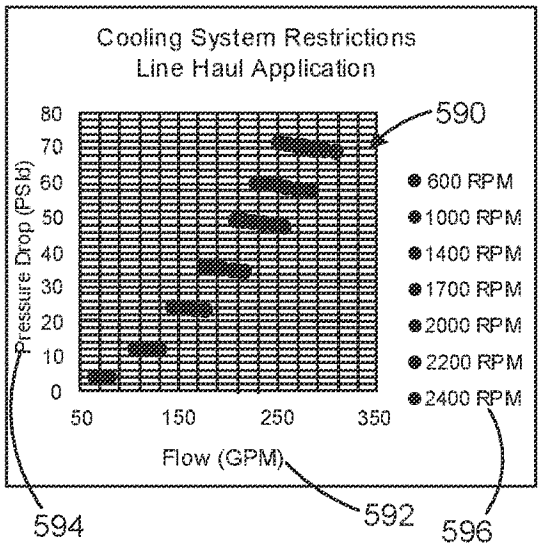
FIGS. 16B and 16C are graphs of coolant pump performance and cooling system restriction, as described herein.
Figure 16A:
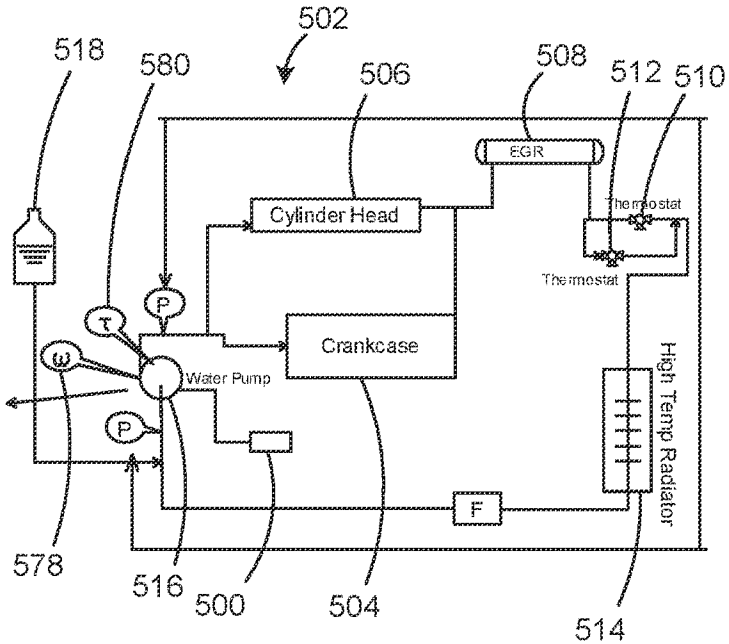
FIG. 16A is an embodiment of a cooling system having a variable speed cooling pump and system and method for the control thereof, as described herein.
Figure 16B:
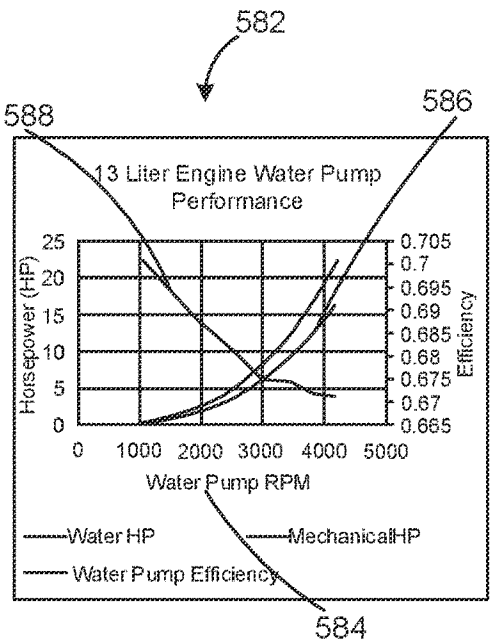

Engine coolant pump performance 582 is shown in a graph at FIG. 16B, wherein coolant pump horsepower 586 and coolant pump efficiency 588 are charted against coolant pump RPM 584. Engine coolant pump performance 582 is used by the system and method of controlling a variable speed coolant pump 516 in modeling the cooling system 502 behavior in the fifth or determination step 210, which again includes determining power savings of the optimized speed coolant pump on an engine emissions cycle. FIG. 16C shows overall cooling system restriction 590 as pressure drop 594 as a function of coolant flow 592 and engine RPM 596. Again, this information may be used in the first or measurement step 202 that includes measuring laboratory heat rejection and hydraulic system performance data of a cooling system 502 of a given configuration, and in the second or calculation step 204 that includes calculating flow and pressures at reduced variable speed coolant pump 516 speeds, as well as in the fifth or determination step 210 that includes determining power savings of the optimized variable speed coolant pump 516 on an engine emissions cycle.

Figure 17:
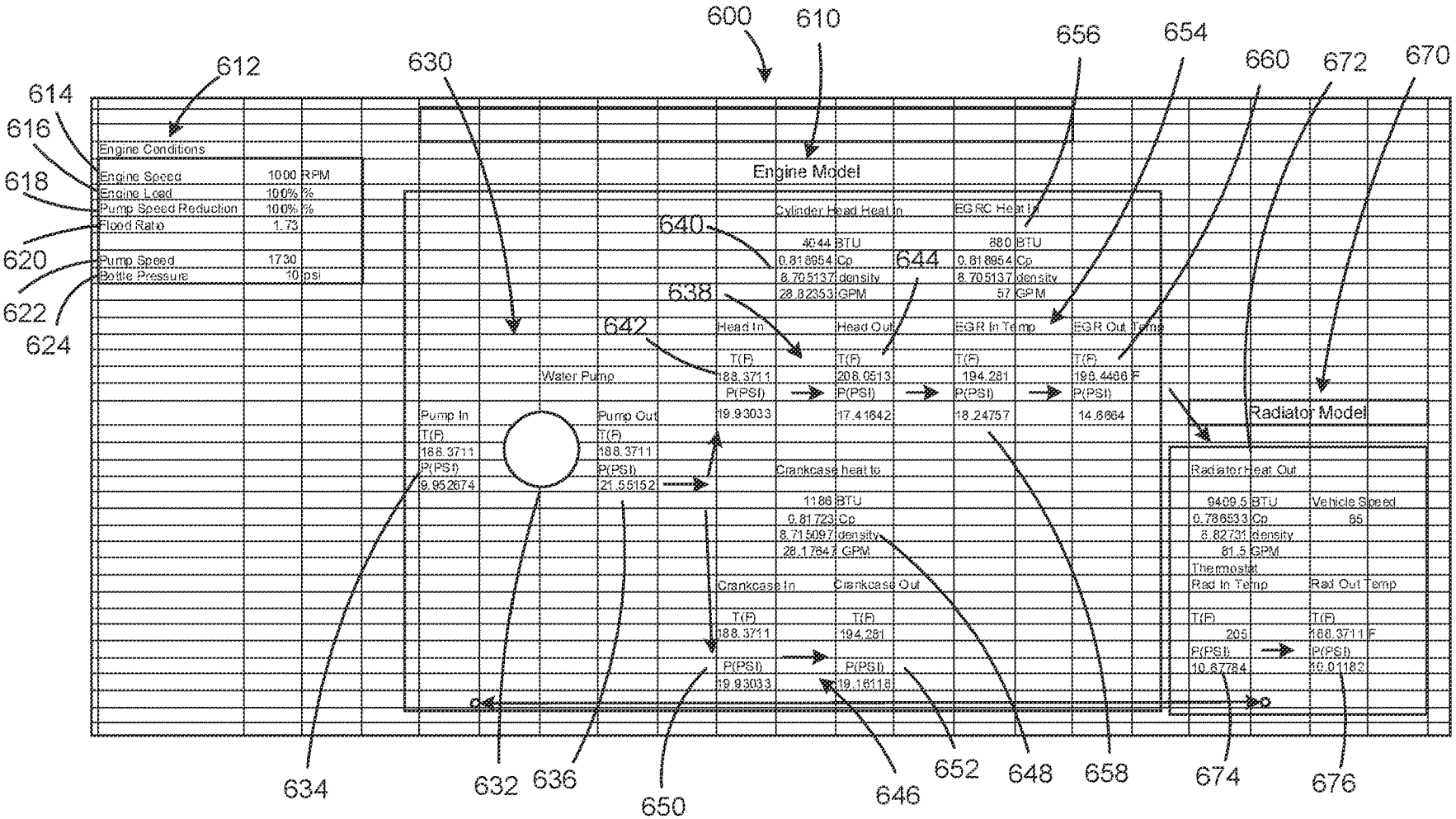
FIG. 17 is graphical representation of an embodiment of a cooling system model used in conjunction with a cooling system having a variable speed cooling pump and system and method for the control thereof.

FIG. 17 shows a cooling system simulation model 600 that may be used by an embodiment of the system and method of controlling a variable speed coolant pump 516 in the third or interpretation step 206 that includes interpreting the measured data using heat transfer equations to predict temperatures at the reduced water pump speeds. The cooling system simulation model 600 interprets measured data using heat transfer equations to predict temperatures and pressures at reduced coolant pump speeds. The cooling system simulation model 600 shown in FIG. 17, of course, is only shown in an initial condition. In the initial condition, the engine conditions 612 of the engine model 610 are such that engine speed 614 is 1000 RPM, engine load percentage 616 is 100%, coolant pump speed reduction/% of engine speed 618 is 100% so that the pump is operating at the fixed ratio 620 of 1.73. This means that pump speed 622 is 1730 RPM. Bottle pressure 624 is 10 Psi.

The cooling system model 630 of the cooling system simulation model 600 begins with the variable speed coolant pump 632 having coolant pump coolant in conditions 634 of 188.4° F. and 10.0 Psi. Coolant pump coolant out conditions 636 are 188.4° F. and 21.6 Psi. Cylinder head 638 has cylinder head coolant in conditions 642 of 188.4° F. and 19.9 Psi. The crankcase coolant in conditions 650 of the crankcase 646 are the same as the cylinder head coolant in conditions 642. The cylinder head 638 experiences cylinder head heat in/conditions 640 of 4044 BTU transferred to coolant having specific heat capacity of 0.81 BTU/° F., density of 8.7 lb/gal, and a flow rate of 28.8 GPM. The crankcase 646 experiences crankcase heat in/conditions 648 of 1186 and a flow rate of 28.2 GPM. The cylinder head coolant out conditions 644 are then 208.1° F. and 17.4 Psi, and the crankcase coolant out conditions 652 are 194.3° F. and 19.1 Psi.

The EGR coolant in conditions 658 of the EGR 654 are 194.3° F. and 18.2 Psi, and the EGR heat in/conditions 656 experienced by the EGR 654 are 880 BTU and a flow rate of 57 GPM. This results in EGR coolant out conditions 660 of 196.4° F. and 14.7 Psi. The radiator model 670 of the cooling system simulation model 600, then, shows that the radiator has radiator coolant in conditions 674 of 205.0° F. and 10.7 Psi. The radiator experiences radiator heat out/conditions 672 of 9409.5 BTU transferred from coolant having specific heat capacity of 0.79 BTU/° F., density of 8.8 lb/gal, and a flow rate of 81.5 GPM. This results in radiator coolant out conditions 676 of 188.4° F. and 10.0 Psi.

Figure 18B:
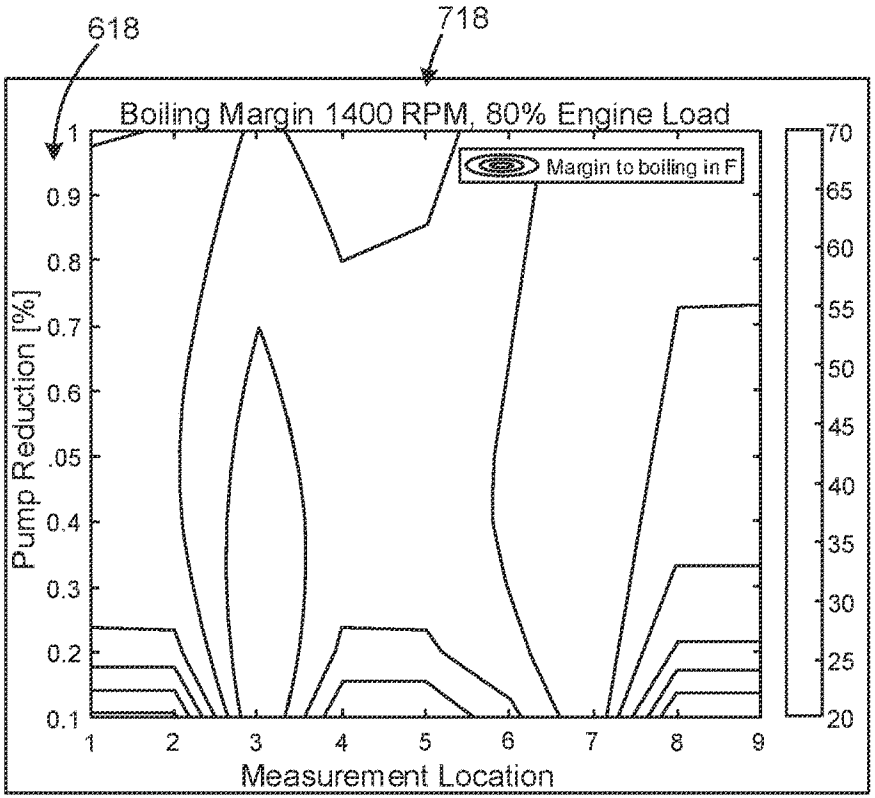
FIG. 18B is a graph of boiling margin at an engine speed of 1400 RPM and 80% engine load at nine cooling system locations, as described herein.
Figure 19B:
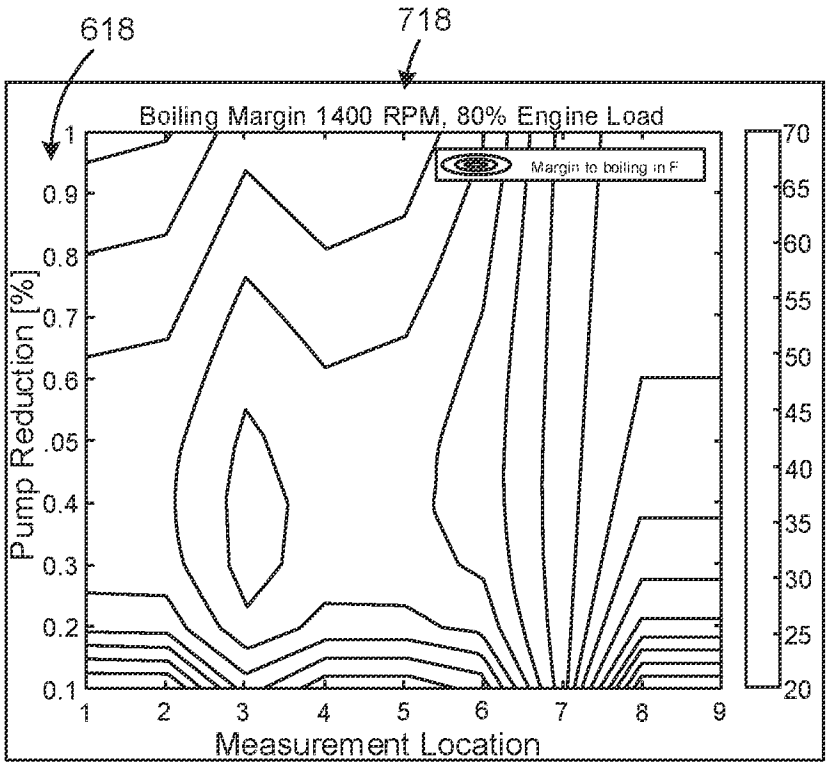
FIGS. 19A and 19B are graphs of boiling margin at an engine speed of 1700 RPM and at 100% engine load and 20% engine load at nine cooling system locations, as described herein.
Figure 19A:
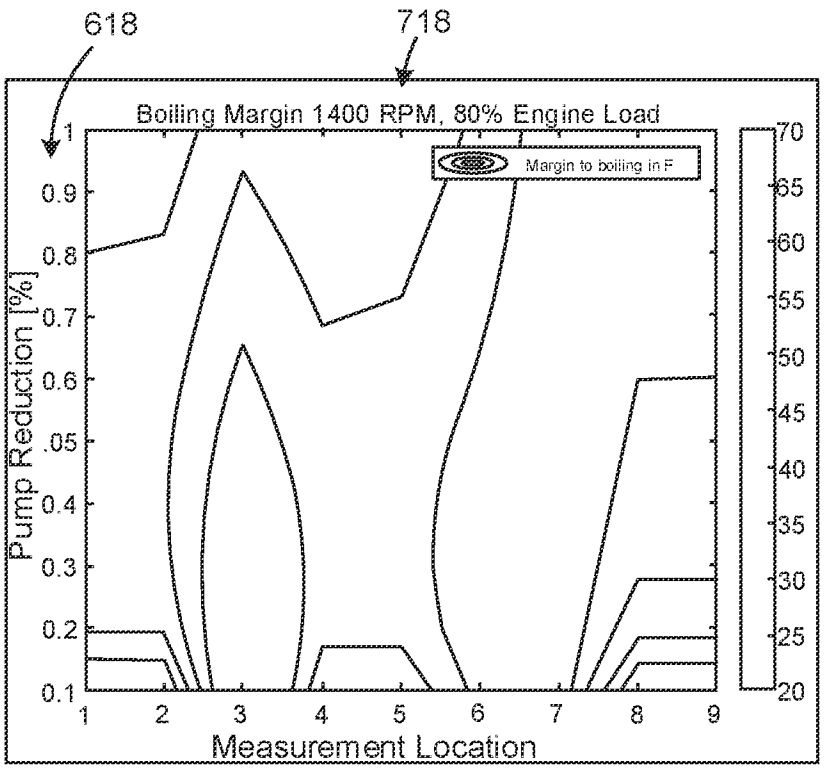

FIGS. 18B, 19A, and 19B show the results or conclusions of calculations of margin to boiling under engine conditions of 1400 RPM/80% engine load, 1700 RPM/100% engine load, and 1700 RPM/20% engine load, respectively. The following case that was studied in order to fix the independent variables in the model:

- The vehicle is traveling at 65 miles per hour, i.e.—has a fixed radiator heat rejection. This is a typical line haul truck speed limit in the United States.
- The vehicle is traveling at sea level where the atmospheric pressure equals 1 Bar.
- The engine thermostat temperature 720 is fixed at 200° F. operating temperature. This is a common engine full thermostat open position.
- The cooling system surge bottle pressure 724 maintains 10 PSIg. This is a common cooling system expansion bottle operating pressure at 200° F. operating temperature.
- The minimum required margin to nucleate boiling is set to 20° F.
- The minimum variable speed coolant pump speed is 30% of its full speed operation.

Figure 18A:
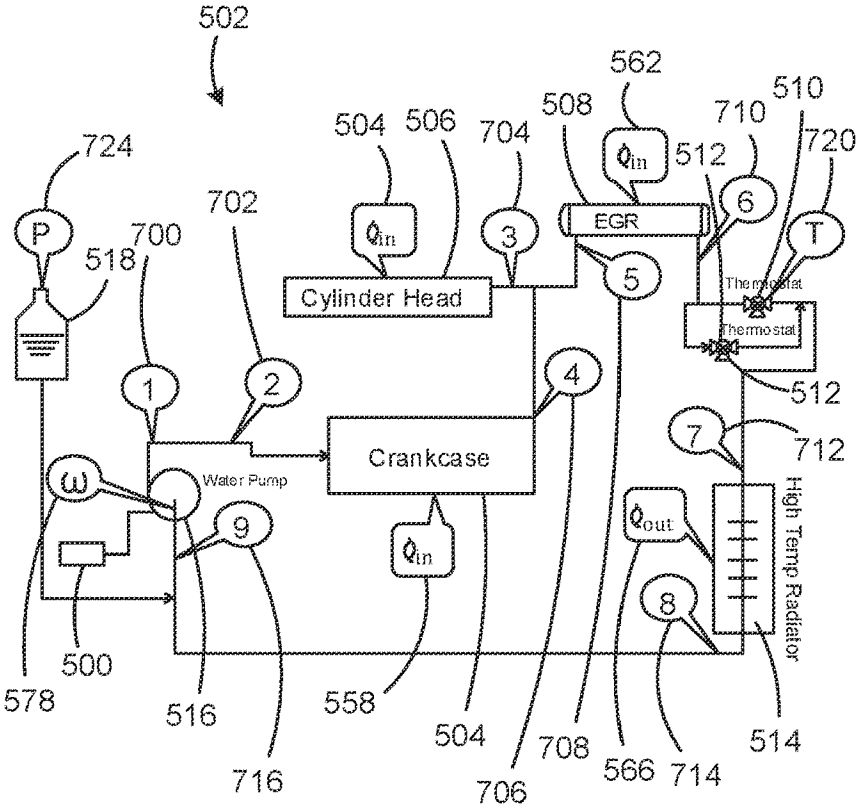
FIG. 18A is an embodiment of a cooling system having a variable speed cooling pump and system and method for the control thereof, as described herein.

For reference FIG. 18A again shows an embodiment of a cooling system 502 for which the powertrain heat rejection data at various engine speeds and loads are obtained as part of the system and method of controlling a variable speed coolant pump 516. The cooling system 502 again has a cooling circuit that includes a variable speed coolant pump 516, cooling passages within a crankcase 504 and cylinder head 506, an EGR cooler 508, a high temperature radiator 514, a first thermostat 510, a second thermostat 512, and a surge tank 518. A controller 500 again controls the speed 578 of the variable speed coolant pump 516. The cylinder head 506 creates a cylinder head heat input 554, the crankcase 504 creates a crankcase heat input 558, the EGR cooler 508 creates an EGR cooler heat input 562, and the high temperature radiator 51 creates a vehicle radiator heat output 566. Nine measurement locations are shown:

- Measurement location 1, coolant pump out 700.
- Measurement location 2, engine in 702.
- Measurement location 3, cylinder head out 704.
- Measurement location 4, crankcase out 706.
- Measurement location 5, EGR in 708.
- Measurement location 6, EGR out 710.
- Measurement location 7, radiator in 712.
- Measurement location 8, radiator out 714.
- Measurement location 9, coolant pump in 716.

Boiling margin 718, then, is shown in FIGS. 18B, 19A, and 19B as a function of coolant pump speed reduction/% of engine speed 618. It can be seen in these Figures that, for example, boiling margin at the cylinder head outlet 704 decreases with reduced variable speed coolant pump 516 speed 578, boiling margin increases at the radiator inlet 712 with reduced engine load, and boiling margin increases at significantly reduced variable speed coolant pump 516 speeds 578 at low engine loads.

Figures 20A, 20B:
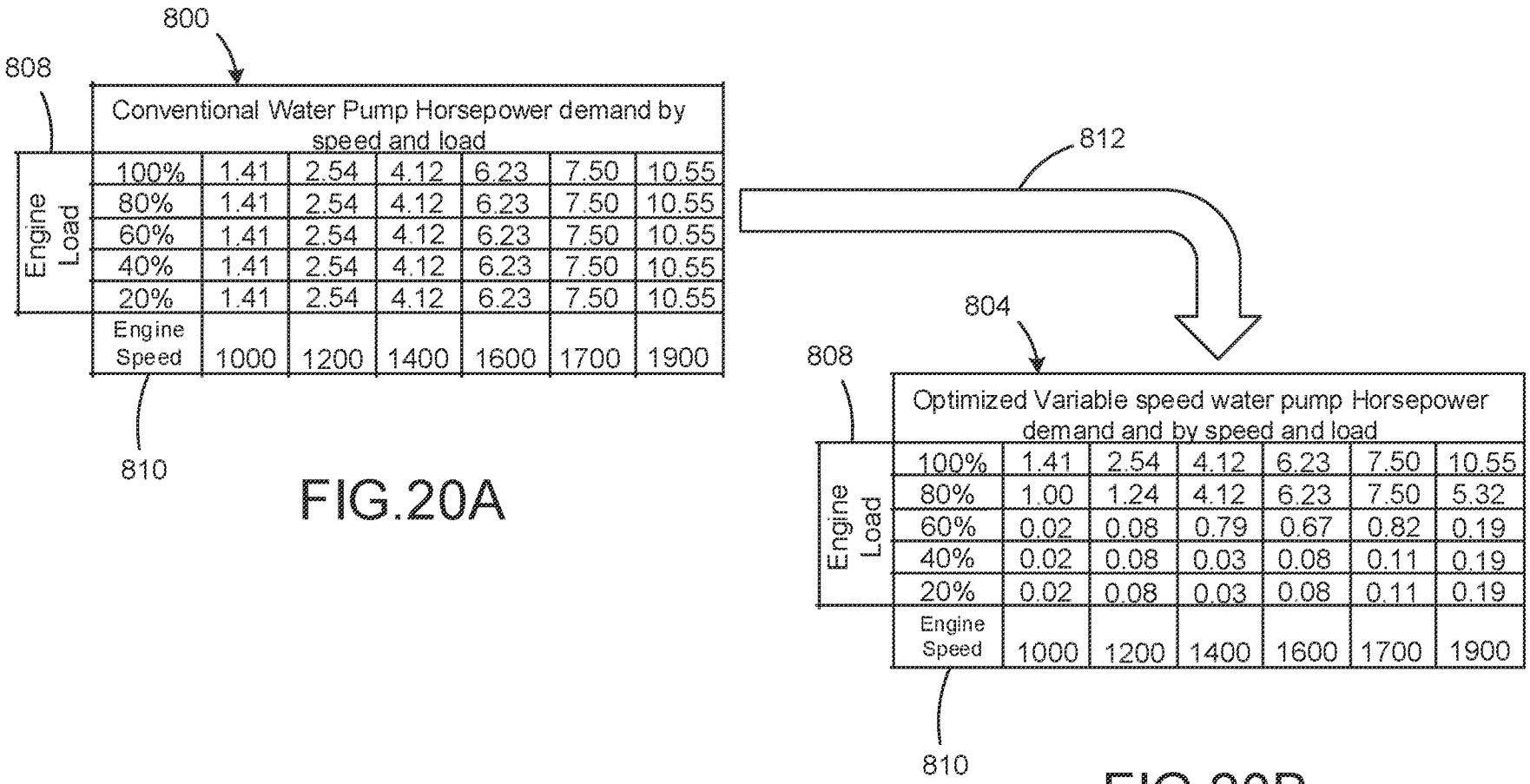
FIGS. 20A and 20B are charts of conventional coolant pump horsepower demand by speed and load, and optimized variable speed coolant pump horsepower demand by speed and load, respectively, as described herein.

FIGS. 20A, 20B, and 21A through 21D show application of variable speed coolant pump speed reductions 812 determined from interpretation of the boiling results, which is part of the fifth or determination step 210 that includes determining power savings of the optimized speed coolant pump on an engine emissions cycle. FIGS. 20A and 21A are charts of conventional coolant pump horsepower demand by speed and load 800, wherein horsepower is charted as a function of engine load 808 and engine speed 810. FIG. 21B is a chart of allowable speed reduction ratio determined from interpretation of boiling results 802, also charted as a function of engine load 808 and engine speed 810. FIGS. 20B and 21C are charts of optimized variable speed coolant pump horsepower demand by speed and load 804, again charted as a function of engine load 808 and engine speed 810. FIG. 21D is a chart of coolant pump power savings as % of conventional pump power demand 806. Power savings from reduced pump speeds are calculated according to the relationship between power and pump speed of:

$$Hp_1/Hp_2=(\omega_1/\omega_2)^3$$

As may be seen, a maximum 99% power savings 814 over conventional pump at reduced load conditions may be obtained by the system and method of controlling a variable speed coolant pump 516.

FIG. 22 shows SET cycle coolant pump power calculations 900 performed in calculating power savings from reduced variable speed coolant pump 516 speeds 578 as part of the fifth or determination step 210 that includes determining power savings of the optimized speed coolant pump 516 on an engine emissions cycle. The SET Cycle 902 is defined by the U.S. EPA, and includes 22 steps 904 in which engine speed 906, flywheel torque 908, and step duration 910. Engine power 912, including direct engine power 914 and weighted engine power 916, may be derived from engine speed 906, flywheel torque 908, and step duration 910. Conventional coolant pump parameters 918 include conventional coolant pump speed 920, which may be derived from engine speed 906. Direct conventional coolant pump drive power 922 then derives from conventional coolant pump speed 920, and weighted conventional coolant pump drive power 924 derives from conventional coolant pump speed 920 and step duration 910. Variable speed coolant pump parameters 926 include the optimized variable speed ratio 928 as determined in the first or measurement step 202, the second or calculation step 204, the third or interpretation step 206, and the fourth or establishment step 208. From the optimized variable speed ratio 928 and engine speed 906, the coolant pump speed at optimized variable speed ratio 930 may be derived. The coolant pump power at the optimized variable speed ratio 932 then derives from the coolant pump speed at optimized variable speed ratio 930, and the weighted variable speed coolant pump drive power 934 derives from the coolant pump speed at optimized variable speed ratio 930 and step duration 910.

FIG. 23A, then, shows the conventional coolant pump power calculated results 950, including cycle average conventional pump power 952, cycle average engine power 954, and conventional pump power % of engine power 956. FIG. 23B shows the optimized variable speed coolant pump power calculated results 960, including cycle average optimized variable speed pump power 962, calculated variable speed pump power savings 964, optimized Variable speed power percentage of average engine power 966, and cycle percentage of power saving compared to conventional coolant pump 968.

While the Variable Speed Coolant Pump Control Strategy, and systems and methods implementing the Variable Speed Coolant Pump Control Strategy, has been described with respect to at least one embodiment, the Variable Speed Coolant Pump Control Strategy, and systems and methods implementing the Variable Speed Coolant Pump Control Strategy, can be further modified within the spirit and scope of this disclosure, as demonstrated previously. This application is therefore intended to cover any variations, uses, or adaptations of the system and method using its general principles. Further, this application is intended to cover such departures from the present disclosure as come within known or customary practice in the art to which the disclosure pertains and which fall within the limits of the appended claims.

What is claimed is:

1. A vehicle having an engine and a cooling system, comprising:

a cooling circuit;

a variable speed coolant pump;

a controller at least one of:

incorporating measured heat rejection and hydraulic system performance data of the cooling system, and being configured to receive from an external source measured heat rejection and hydraulic system performance data of the cooling system;

the controller further being at least one of:

configured to calculate coolant flow and pressures at reduced coolant pump speeds, and configured to receive from an external source calculated coolant flow and pressures at reduced coolant pump speeds;

the controller further being at least one of:

configured to predict coolant temperatures at the reduced coolant pump speeds, and configured to receive from an external source predicted coolant temperatures at the reduced coolant pump speeds;

the controller further being at least one of:

configured to establish a maximum allowable heat flux to avoid boiling of the coolant based on a saturation temperature; and configured to receive from an external source an established maximum allowable heat flux to prevent boiling of the coolant based on the saturation temperature; and the controller being configured to optimize the speed of the variable speed coolant pump to prevent the coolant from boiling and exceeding the maximum allowable heat flux.

2. The vehicle of claim 1, wherein:

the controller further being at least one of:

configured to determine power savings of the optimized speed coolant pump, and configured to send to an external source power savings of the optimized speed coolant pump.

3. The vehicle of claim 2, wherein:

the controller is configured to determine power savings of the optimized speed coolant pump over an engine emissions cycle.

4. The vehicle of claim 1, wherein:

the heat rejection and hydraulic system performance data of the cooling system includes at least one of:

component hydraulic restrictions, coolant pump performance, cylinder head heat rejection to the cooling system, crankcase heat rejection to the cooling system, EGR cooler heat rejection to the cooling system, and vehicle radiator heat rejection to the environment.

5. The vehicle of claim 1, wherein:

the controller is configured to calculate flow and pressures at reduced coolant pump speeds using pump affinity laws;

the controller being configured to predict coolant temperatures at the reduced coolant pump speeds by interpreting the measured data using heat transfer equations; and the controller being configured to establish a maximum allowable heat flux to avoid boiling of the coolant using at least one heat flux graph.

6. The vehicle of claim 5, wherein:

the controller is configured to establish a maximum allowable heat flux to avoid boiling of the coolant by keeping it in a region characterized by interface evaporation pure convection or a region characterized by nucleate boiling bubbles condensing.

7. The vehicle of claim 5, wherein:

the controller is configured to establish a maximum allowable heat flux to avoid boiling of the coolant at least one of:

at a first measurement location at coolant pump out, at a second measurement location at engine in, at a third measurement location at cylinder head out, at a fourth measurement location at crankcase out, at a fifth measurement location at EGR in, at a sixth measurement location at EGR out, at a seventh measurement location at radiator in, at an eighth measurement location at radiator out, and at a ninth measurement location at coolant pump in.

8. The vehicle of claim 1, wherein:

the variable speed cooling pump is at least one of:

continuously variable, and incrementally variable.

9. A cooling system of a vehicle having an engine, comprising:

a cooling circuit;

a variable speed coolant pump;

a controller at least one of:

incorporating measured heat rejection and hydraulic system performance data of the cooling system, and being configured to receive from an external source measured heat rejection and hydraulic system performance data of the cooling system;

the controller further being at least one of:

configured to calculate coolant flow and pressures at reduced coolant pump speeds, and configured to receive from an external source calculated coolant flow and pressures at reduced coolant pump speeds;

the controller further being at least one of:

configured to predict coolant temperatures at the reduced water coolant pump speeds, and configured to receive from an external source predicted coolant temperatures at the reduced water coolant pump speeds;

the controller further being at least one of:

configured to establish a maximum allowable heat flux to avoid boiling of the coolant based on a saturation temperature; and configured to receive from an external source an established maximum allowable heat flux to prevent boiling of the coolant based on the saturation temperature; and the controller being configured to optimize the speed of the variable speed coolant pump to prevent the coolant from exceeding the maximum allowable heat flux.

10. The cooling system of claim 9, wherein:

the controller further being at least one of:

configured to determine power savings of the optimized speed coolant pump, and configured to send to an external source power savings of the optimized speed coolant pump.

11. The cooling system of claim 10, wherein:

the controller being configured to determine power savings of the optimized speed coolant pump over an engine emissions cycle.

12. The cooling system of claim 9, wherein:

the heat rejection and hydraulic system performance data of the cooling system including at least one of:

component hydraulic restrictions, coolant pump performance, cylinder head heat rejection to the cooling system, crankcase heat rejection to the cooling system, EGR cooler heat rejection to the cooling system, and vehicle radiator heat rejection to the environment.

13. The cooling system of claim 9, wherein:

the controller being configured to calculate flow and pressures at reduced coolant pump speeds using pump affinity laws;

the controller being configured to predict coolant temperatures at the reduced coolant pump speeds by interpreting the measured data using heat transfer equations; and the controller being configured to establish a maximum allowable heat flux to avoid boiling of the coolant using at least one heat flux graph.

14. The cooling system of claim 13, wherein:

the controller being configured to establish a maximum allowable heat flux to avoid boiling of the coolant by keeping it in a region characterized by interface evaporation pure convection or a region characterized by nucleate boiling bubbles condensing.

15. The cooling system of claim 13, wherein:

the controller being configured to establish a maximum allowable heat flux to avoid boiling of the coolant at least one of:

at a first measurement location at coolant pump out, at a second measurement location at engine in, at a third measurement location at cylinder head out, at a fourth measurement location at crankcase out, at a fifth measurement location at EGR in, at a sixth measurement location at EGR out, at a seventh measurement location at radiator in, at an eighth measurement location at radiator out, and at a ninth measurement location at coolant pump in.

16. The cooling system of claim 9, wherein:

the variable speed cooling pump being at least one of:

continuously variable, and incrementally variable.

17. A method of cooling the engine of a vehicle, comprising the steps of:

first, providing a cooling circuit;

second, providing a variable speed coolant pump;

third, at least one of:

incorporating within a controller measured heat rejection and hydraulic system performance data of the cooling system, and configuring the controller to receive from an external source measured heat rejection and hydraulic system performance data of the cooling system;

fourth, configuring the controller to at least one of:

calculate coolant flow and pressures at reduced coolant pump speeds, and receive from an external source calculated coolant flow and pressures at reduced coolant pump speeds;

fifth, configuring the controller to at least one of:

predict coolant temperatures at the reduced coolant pump speeds, and receive from an external source predicted coolant temperatures at the reduced coolant pump speeds;

sixth, configuring the controller to at least one of:

establish a maximum allowable heat flux to avoid boiling of the coolant based on a saturation temperature; and receive from an external source an established maximum allowable heat flux to prevent boiling of the coolant based on the saturation temperature; and seventh, configuring the controller to optimize the speed of the variable speed coolant pump to prevent the coolant from exceeding the maximum allowable heat flux.

18. The method of claim 17, further comprising the step of:

configuring the controller to at least one of:

determine power savings of the optimized speed coolant pump on an engine emissions cycle, and send to an external source power savings of the optimized speed coolant pump on an engine emissions cycle.

19. The method of claim 17, wherein:

the heat rejection and hydraulic system performance data of the cooling system including at least one of:

component hydraulic restrictions, coolant pump performance, cylinder head heat rejection to the cooling system, crankcase heat rejection to the cooling system, EGR cooler heat rejection to the cooling system, and vehicle radiator heat rejection to the environment.

20. The method of claim 17, further comprising the steps of:

configuring the controller to establish a maximum allowable heat flux to avoid boiling of the coolant using at least one heat flux graph; and further configuring the controller to establish a maximum allowable heat flux to avoid boiling of the coolant by keeping it in a region characterized by interface evaporation pure convection or a region characterized by nucleate boiling bubbles condensing.

* * * * *